US012037750B2

(12) United States Patent
Singleton et al.

(10) Patent No.: US 12,037,750 B2
(45) Date of Patent: Jul. 16, 2024

(54) GAUGE PLATE INSULATOR

(71) Applicant: Koppers Delaware, Inc., Wilmington, DE (US)

(72) Inventors: Steven D. Singleton, Sarver, PA (US); William Thomas Urmson, Jr., Valencia, PA (US); John W. Mospan, Pittsburgh, PA (US); Ronald K. Junk, Cabot, PA (US)

(73) Assignee: Koppers Delaware, Inc., Wilmington, DE (US)

( * ) Notice: Subject to any disclaimer, the term of this patent is extended or adjusted under 35 U.S.C. 154(b) by 814 days.

(21) Appl. No.: 17/151,925

(22) Filed: Jan. 19, 2021

(65) Prior Publication Data

US 2021/0148058 A1 May 20, 2021

Related U.S. Application Data

(62) Division of application No. 15/966,398, filed on Apr. 30, 2018, now abandoned.

(60) Provisional application No. 62/501,327, filed on May 4, 2017.

(51) Int. Cl.

| | |
|---|---|
| ***E01B 11/54*** | (2006.01) |
| ***E01B 5/16*** | (2006.01) |
| ***E01B 7/02*** | (2006.01) |
| ***E01B 11/44*** | (2006.01) |

(52) U.S. Cl.

CPC ..... *E01B 11/54* (2013.01); *E01B 5/16* (2013.01); *E01B 7/02* (2013.01); *E01B 11/44* (2013.01)

(58) Field of Classification Search

CPC ... E01B 5/16; E01B 7/02; E01B 11/44; E01B 11/54

See application file for complete search history.

(56) References Cited

U.S. PATENT DOCUMENTS

| | | | | |
|---|---|---|---|---|
| 1,349,352 | A * | 8/1920 | Whiteman | E01B 11/54 238/249 |
| 3,556,888 | A | 1/1971 | Goldsworthy | |
| 3,730,310 | A | 5/1973 | Spiringer | |
| 4,883,552 | A | 11/1989 | O'Connor et al. | |
| 6,170,756 | B1 | 1/2001 | Adkins et al. | |

(Continued)

OTHER PUBLICATIONS

"S-Glass Fibre", AZO Materials, AZoM.com, 2001.
"SAE Hardened Flat Washer For Grade 8 Applications", Earnest, EarnestMachine.com, 2015.

*Primary Examiner* — Robert J McCarry, Jr.
(74) *Attorney, Agent, or Firm* — The Webb Law Firm

(57) ABSTRACT

A gauge plate insulator includes an L-shaped insulating member having a base configured to be positioned between first and second gauge plate members and a leg extending from the base, a metallic backing plate having a first part configured to engage a first gauge plate member, a second part configured to engage the leg of the L-shaped insulating member, and a third part extending between the first part and the second part of the metallic backing plate, a first fastener configured to be received by a first opening and a second fastener configured to be received by a second opening defined by the second part of the metallic backing plate and an opening defined by the leg of the L-shaped insulating member, and an insulation plate configured to be positioned between a portion of the second fastener and the second part of the metallic backing plate.

13 Claims, 25 Drawing Sheets

(56) References Cited

U.S. PATENT DOCUMENTS

| | | | |
|---|---|---|---|
| 6,997,419 | B1 | 2/2006 | Remington et al. |
| 8,870,088 | B2 | 10/2014 | Dufresne |
| 9,234,314 | B2 | 1/2016 | Habel et al. |
| 2016/0251807 | A1 | 9/2016 | Hawkins et al. |
| 2017/0113423 | A1 | 4/2017 | McCroskey et al. |
| 2017/0183828 | A1 | 6/2017 | Jia et al. |

* cited by examiner

GAUGE PLATE INSULATOR

CROSS-REFERENCE TO RELATED APPLICATION

This application is a divisional of U.S. application Ser. No. 15/966,398, filed Apr. 30, 2018, which claims priority to U.S. Provisional Application Ser. No. 62/501,327, filed May 4, 2017, which is hereby incorporated by reference in its entirety.

BACKGROUND OF THE INVENTION

Field of the Invention

The present invention relates to an insulating joint for use in a rail system to electrically isolate parts of the rail system from each other.

Description of Related Art

A rail system is generally divided into sections or blocks to be able to detect trains which permits more trains to travel on one stretch of track or rail. Each section is electrically isolated from all other sections so that when no train is present in the section, a high electrical resistance can be measured over the parallel railbars in the section. When a train enters a section, the train short circuits adjacent railbars and the electrical resistance drops.

Railbars are generally welded to each other or attached to each other by a steel joint. High performance non-metallic joints are used for electrically isolating two railbars in order to build an electrically isolated section. Switches are insulated in the same way by dividing both the gauge plate and switch rods into two parts and by joining the respective parts with a non-metallic or insulating joint.

Known non-metallic joints are very expensive because of the special high performance material which has to endure high tensile and flexural forces. In addition, a separate insulating plug must be utilized between ends of the gauge plate or switch rod to prevent material buildup of debris which would then cause an electrical short.

U.S. Pat. No. 6,170,756 discloses a prior art gauge plate and switch rod insulator. FIGS. 1-8 of U.S. Pat. No. 6,170,756 are reproduced as FIGS. 1-8 of the present application. FIG. 1 shows a conventional gauge plate used to connect a first part or first member 10 and a second part or second member 12 of a switch rod. The switch rod is attached by brackets 14 to the movable laterally spaced apart railbars of a switch which are used to maintain the gauge between movable railbars.

Two parts 10 and 12 are connected to each other by two T-shaped insulating joints or switch plates 16 having T-shaped cross sections. Each insulating joint 16 includes a metallic core encased with an electrically insulating material. Each core is T-shaped with a flat body 17*a* having a leg or ridge 17*b* depending therefrom Likewise, the insulating joint 16 includes a flat body 17*c* and a depending leg 17*d*. The depending leg 17*d* is received within a gap G defined between the first part 10 and the second part 12. Ends of the depending legs 17*d* abut against each other. Alternatively, it is believed that the metallic core can be a flat plate encased with an electrically insulating material replacing the depending leg or ridge 17*b* completely with insulating material as shown in FIG. 8. Alternatively, the insulating joints can be flat as opposed to T-shaped and an electric insulative filling can be provided between the insulating joints in the gap G defined by the opposed ends of the first part 10 and the second part 12 for electrically insulating these two parts 10 and 12 from each other. The insulating joints 16 are secured to the first part 10 and the second part 12 by a fastening arrangement of bolts 20, nuts 22, and washers 24.

More specifically, the insulating joint 16 includes a steel core 26 with a plurality of holes defined therein through which bolts 20 extend, an insulating layer 28 encasing the steel core 26, and a plurality of bushings 30 provided in the holes. FIG. 2 shows the bushings 30, which are electrically insulated from the steel core 26. Either the bushings 30 can have a separate bonded insulating layer or the insulating layer can be provided by the insulating layer 28.

The steel core 26, not the insulating layer 28, withstands tensile forces applied to the insulating joint 16 through parts 10 and 12. The bushings 30 protect the steel core 26 and the insulating layer 28 from wear caused by the bolts 20. As is evident, the installed T-shaped insulating joint 16 sandwiches ends E and E' of the two parts 10 and 12 and are secured thereto.

FIGS. 3, 6, and 7 show a second embodiment of an insulating joint or gauge plate 40 for insulating a first part or first member 42 and a second part or second member 44 for maintaining the gauge of two rails 46 of a switch. The first part 42 and the second part 44 extend from respective laterally spaced apart rails 46.

The insulating joint or gauge plate 40 is T-shaped, i.e., has a T-shaped cross section, such that a part of the insulating joint 40 prevents the ends of the first part 42 and the second part 44 from making electrical contact. The insulating joint 40 includes a steel T-shaped core 48, a first electrically insulating layer 50, which encases the core 48, and steel bushings 52. As shown in FIG. 4, outer surfaces of each of the steel bushings 52 are covered with a second electrically insulating layer 54. The T-shaped core 48 of the insulating joint 40, likewise, includes a flat body 47*a* and a depending leg 47*b*. The insulating joint 40 includes a flat body 47*c* and a depending leg 47*d*. The depending leg 47*d* is received within a gap G' between the first part 42 and the second part 44. Bolts 56, nuts 58, and washers 59 secure the insulating joint 40 to the first part 42 and the second part 44.

FIG. 8 shows another embodiment of an insulating joint 40' that is similar to the insulating joint 40 shown in FIGS. 3, 6, and 7. The only difference between insulating joint 40' and insulating joint 40 is that the core 48 of insulating joint 40 is replaced with a flat plate core 48' of the insulating joint 40' and the "T" is formed totally by the first electrically insulating layer 50.

FIG. 5 shows an insulating joint 60 similar to the insulating joint 16 described above and can be used in a switch rod in lieu of insulating joints 16. The insulating joint 60 includes a T-shaped steel core 62, a first insulating layer 64, and the steel bushings 52 having a second electrically insulating layer 54 shown in FIG. 4. The insulating joint 60 is T-shaped such that, by mounting two insulating joints 60 on a switch rod, the insulating joints 60 abut and entirely fill the space between the two ends of the switch rod parts. Holes 66 are provided for receipt of the steel bushings 52, which are used to receive fasteners. The bushings 52 and 30 define holes H that align with respective holes H' defined in the first parts 10 and 42 and second parts 12 and 44 for receipt of the bolts 20 and 56, respectively, and the bolts 20 and 56 are electrically insulated from the respective metallic cores 26, 48, and 62.

All of the insulating joints are made by placing or providing the steel core in a mold and molding around the steel core electrically insulating material, such as polyurethane, rubber, or other polymeric material, thereby forming a T-shaped electrically insulating plate. The metallic core can be flat or T-shaped. The bushings at that time can be cast in place. After the polyurethane hardens, the insulating rail joint is removed from the mold and if the bushings for receipt of fasteners, such as bolts 20 and 56, are not cast in place during molding, they can then be received by the insulating joint holes.

SUMMARY OF THE INVENTION

In one aspect, a gauge plate insulator includes a body having a first side and a second side positioned opposite the second, with the first side of the body defining a planar surface, and the body defining a first opening and a second opening, and a leg extending from the second side of the body and configured to be positioned between first and second gauge plate members. The leg is positioned between the first and second openings of the body, with the body and leg formed integrally from a fiber-reinforced polymer.

The fiber-reinforced polymer may include at least one of fiberglass-reinforced polyester, fiberglass-reinforced vinyl ester, fiberglass-reinforced polyurethane, and fiberglass-reinforced epoxy. The fiber-reinforced polymer may include at least one of E-class fiberglass and S-class fiberglass.

The gauge plate insulator may further include a first fastener configured to be received by the first opening and to secure the body to a first gauge plate member and a second fastener configured to be received by the second opening and to secure the body to a second gauge plate member. The first and second fasteners may each be a Huck collar and Huck pin. The gauge plate insulator may further include a first washer configured to be positioned between a portion of the first fastener and the body and a second washer configured to be positioned between a portion of the second fastener and the body. The first and second washers may each be a hardened flat washer.

The gauge plate insulator may further include a metallic plate, first and second insulating washers, and first and second insulating bushings, with the metallic plate configured to be received by the first side of the body and defining first and second openings corresponding to the first and second openings of the body. The first insulating washer is configured to be positioned between a portion of the first fastener and the metallic plate, with the second insulating washer configured to be positioned between a portion of the second fastener and the metallic plate. The first insulated bushing may be received within the first opening and configured to receive the first fastener and the second insulated bushing may be received within the second opening and configured to receive the second fastener.

The first opening may include a pair of spaced-apart openings and the second opening may include a pair of spaced-apart openings, with the gauge plate insulator further including a first elongate metallic plate extending between the pair of spaced-apart openings of the first opening, and a second elongate metallic plate extending between the pair of spaced-apart openings of the second opening. The first and second elongate metallic plates may be positioned parallel to the leg. The gauge plate insulator may further include an insulating plate positioned in the first side of the body. The insulating plate may be formed from glass fabric impregnated with epoxy resin.

In a further aspect, a method of manufacturing a gauge plate insulator including a body having a first side and a second side positioned opposite the second, and a leg extending from the second side of the body and configured to be positioned between first and second gauge plate members, includes: impregnating a fiber reinforcement with resin; pulling the fiber reinforcement impregnated with the resin through a forming die to form a profile of the body and leg of the gauge plate insulator; heating the profile to cure the resin; and cutting the profile to a predetermined length.

In a further aspect, a gauge plate insulator includes a pair of laterally spaced, elongated, planar metallic cores, with each of the laterally spaced, elongated, planar metallic cores extending in a first direction, and an electrically insulating material encasing the pair of laterally spaced, elongated, planar metallic cores, with the electrically insulating material defining an insulating member that includes a T-shaped cross section defined by a body of the electrically insulating material and a leg of the electrically insulating material that depends from the body. The depending leg having an elongated dimension that extends in a second direction laterally to the first direction.

Each elongated, planar metallic core may have a first end and a second end with the elongated dimension of the depending leg extending between the first and second ends of each elongated, planar metallic core. The gauge plate insulator may include a plurality of fastener holes, with each fastener hole extending through the body of the electrically insulating member and one of the metallic cores. Each metallic core may include two of the plurality of fastener holes, where one of the two fastener holes of the metallic core is positioned between the elongated dimension of the depending leg and the first end of the metallic core, and the other of the two fastener holes of the metallic core is positioned between the elongated dimension of the depending leg and the second end of the metallic core.

The gauge plate insulator may further include an insulating bushing in each fastener hole. The body of the electrically insulating material may define a pair of plateaus that extend above a surface of the body that faces away from the depending leg, where each plateau encases a surface of one of the metallic cores that faces away from the depending leg and at least a part of a side of the metallic core. A top of the electrically insulating member may form an H-shape.

In a further aspect, a gauge plate insulator includes an L-shaped insulating member having a base configured to be positioned between first and second gauge plate members and a leg extending from the base, a metallic backing plate having a first part configured to engage a first gauge plate member, a second part configured to engage the leg of the L-shaped insulating member, and a third part extending between the first part and the second part of the metallic backing plate and configured to engage a portion of the base of the L-shaped insulating member, a first fastener configured to be received by a first opening defined by the first part of the metallic backing plate to secure the metallic backing plate to a first gauge plate member and a second fastener configured to be received by a second opening defined by the second part of the metallic backing plate and an opening defined by the leg of the L-shaped insulating member, and an insulation plate configured to be positioned between a portion of the second fastener and the second part of the metallic backing plate.

In a further aspect, a gauge plate assembly includes a first gauge plate member having a thick section and a thin section adjacent an end of the first gauge plate member, a second gauge plate member having a thick section and a thin section adjacent an end of the second gauge plate member, with a portion of the thin section of the first gauge plate member overlapping a portion of the thin section of the second gauge plate member, an insulating member positioned between the first and second gauge plate members, at least one fastener extending through an opening extending through the thin sections of the first and second gauge plate members and the insulating member, and an insulation plate positioned between a portion of the at least one fastener and the thin section of the second gauge plate member.

The insulating member may be thicker adjacent to a transition between the thick section and the thin section of the first gauge plate member, and the insulating member may be thicker adjacent to a transition between the thick section and the thin section of the second gauge plate member. The insulation plate may be formed integrally with the insulating member.

DESCRIPTION OF THE INVENTION

Figure 1:
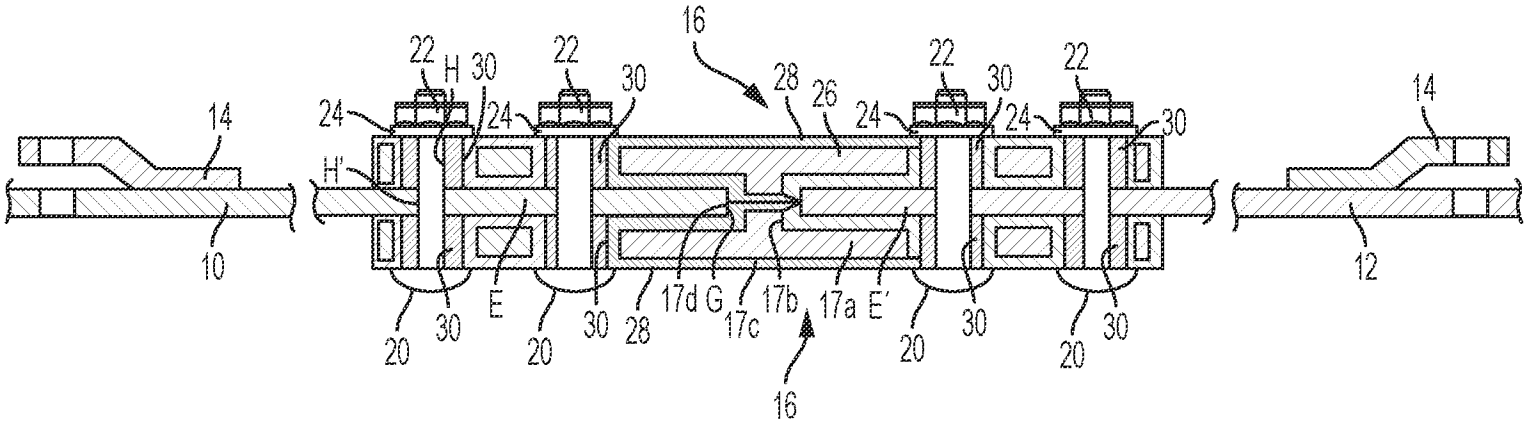
Fig. 1 PRIOR ART
FIG. 1 is a sectional view of a first example prior art switch rod joint.
Figure 2:
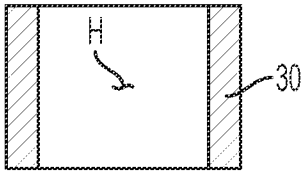
Fig. 2 PRIOR ART
FIG. 2 is a sectional view of a bushing shown in FIG. 1.

For purposes of the description hereinafter, the terms "end," "upper," "lower," "right," "left," "vertical," "horizontal," "top," "bottom," "lateral," "longitudinal," and derivatives thereof shall relate to the example(s) as oriented in the drawing figures. However, it is to be understood that the example(s) may assume various alternative variations and step sequences, except where expressly specified to the contrary. It is also to be understood that the specific example(s) illustrated in the attached drawings, and described in the following specification, are simply exemplary embodiments or aspects of the invention. Hence, specific dimensions and other physical characteristics related to the embodiments or aspects disclosed herein are not to be considered as limiting.

Figure 9A:
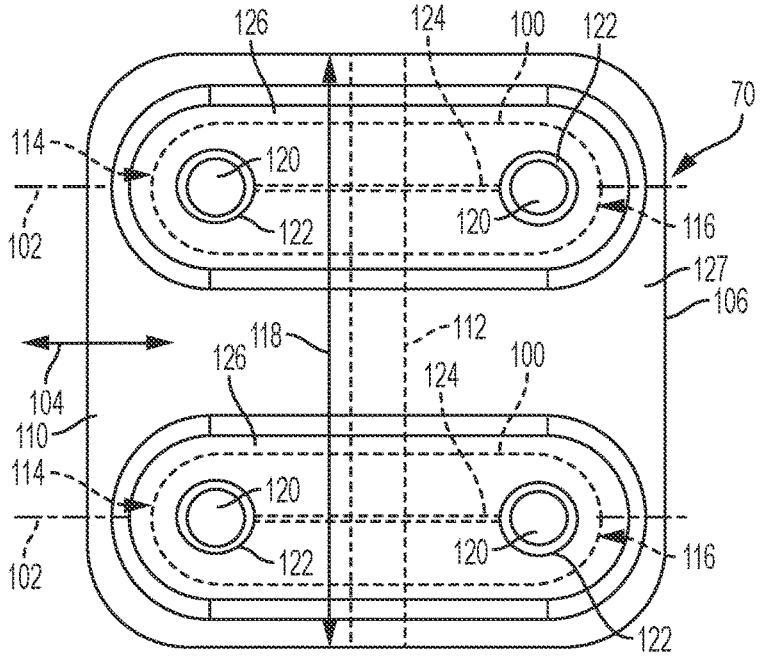
FIG. 9A is a top view of a gauge plate in accordance with one embodiment of the present application.
Figure 9C:
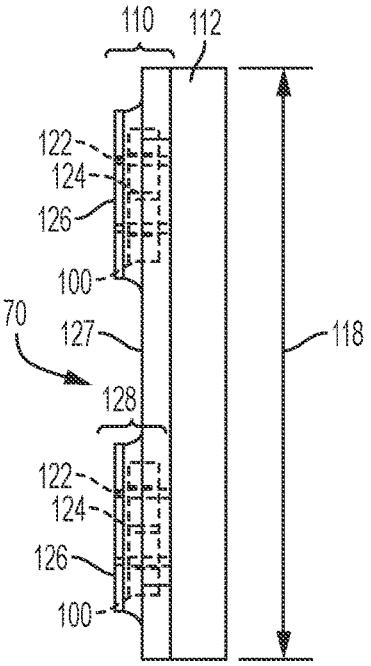
FIG. 9C is a side view of the gauge plate of FIG. 9A.
Figure 9B:
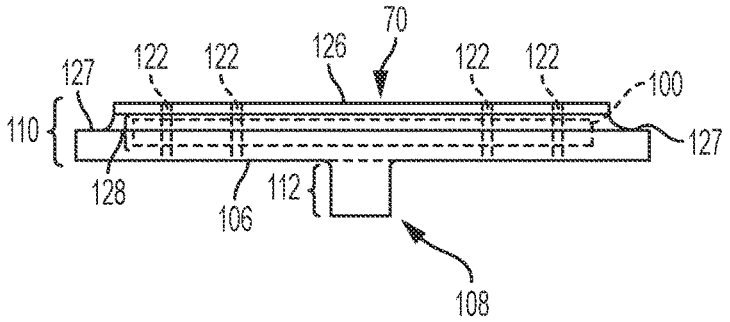
FIG. 9B is a front view of the gauge plate of FIG. 9A.

With reference to FIGS. 9A-9C, a gauge plate insulator 70 according to one embodiment includes a pair of laterally spaced elongated planar metallic cores 100. Longitudinal axes 102 of the metallic cores 100 extend in a first direction shown by two-headed arrow 104. In an example, the metallic cores 100 can be made of steel, although other suitable materials may be utilized. Each metallic core 100 includes a first end 114 and a second end 116. An electrically insulating material 106 encases the pair of metallic cores 100. The electrically insulating material 106 defines a T-shaped electrically insulating member that includes a T-shaped cross section 108 defined by a body 110 of the electrically insulating material 106 and a depending leg 112 of the electrically insulating material that depends from said body 110.

The depending leg 112 has an elongated dimension that extends in a second direction 118 laterally to the first direction 104. In an example, the elongated dimension of the depending leg 112 extends intermediate the first and second ends 114, 116 of each metallic core 100.

The gauge plate insulator 70 includes a plurality of fastener holes 120. Each fastener hole 120 extends through the body 110 of the T-shaped electrically insulating member and one of the metallic cores 100.

In an example, each metallic core 100 is comprised of two fastener holes 120. One of said two fastener holes 120 of the metallic core 100 is positioned between the elongated dimension 118 of the depending leg 112 and the first end 114 of the metallic core 100. The other of said two fastener holes 120 of the metallic core 100 is positioned between the elongated dimension 118 of the depending leg 112 and the second end 116 of the metallic core 100. An electrically insulating bushing 122 can be included in each fastener hole 120 to electrically insulate metallic cores 100 from the shaft of fasteners (not shown) inserted in said bushings 122.

In an example, the electrically insulating material 106 can be polyurethane, although other suitable materials may be utilized.

Optionally, each metallic core 100 can include an expansion slot 124 that extends between the fastener holes 120 at the first and second ends 114, 116 of said metallic core 100. The optional expansion slot 124 of each metallic core 100 can enable said metallic core 100 to withstand vibration and/or changes in temperature without deformation.

The body 110 of the electrically insulating material 106 can define a pair of optional plateaus 126 that extend above the surface 127 of the body 110 that faces away from the depending leg 112. As can be seen, each plateau 126 encases a surface of one of the metallic cores 100 that faces away from the depending leg 112 and at least part of a side 128 of said metallic core 100. The pair of plateaus 126 are laterally spaced from each other in the second direction 118 and have longitudinal axes that extend in the first direction shown by two-headed arrow 104.

Figure 3:
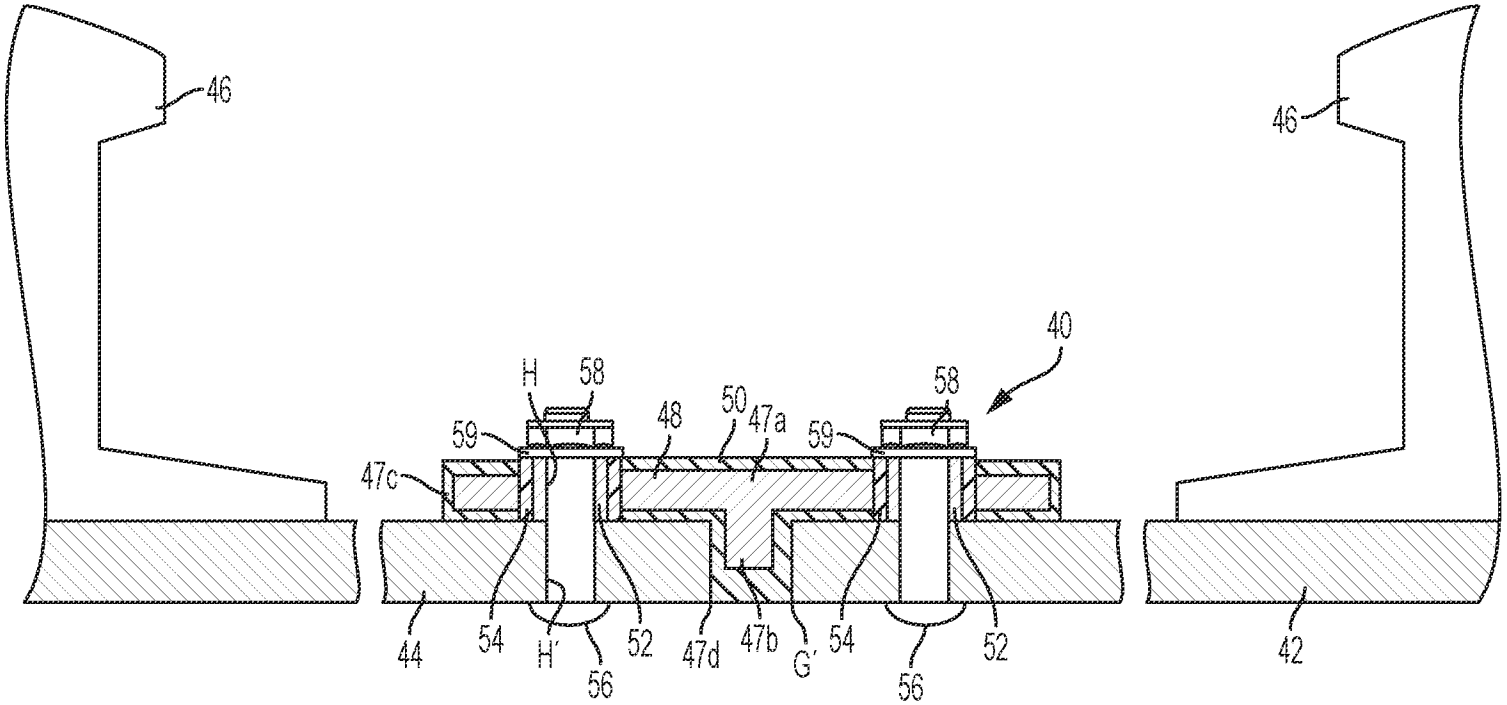
Fig. 3 PRIOR ART
FIG. 3 is a sectional view of a second example prior art gauge plate joint.
Figure 4:
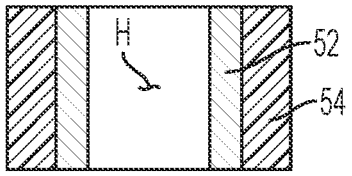
Fig. 4 PRIOR ART
FIG. 4 is a sectional view of a bushing shown in FIG. 3.
Figure 5:
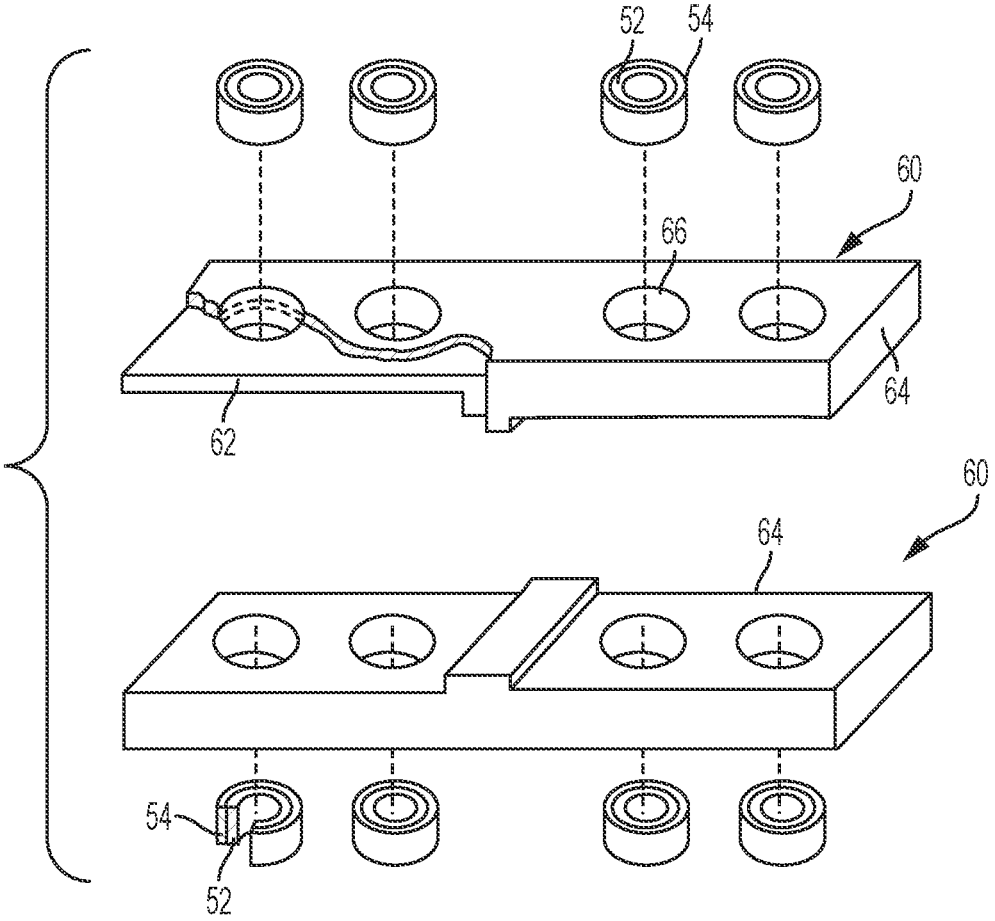
Fig. 5 PRIOR ART
FIG. 5 is an exploded view, partially in section, of a third example prior art switch rod insulator plate.
Figure 6:
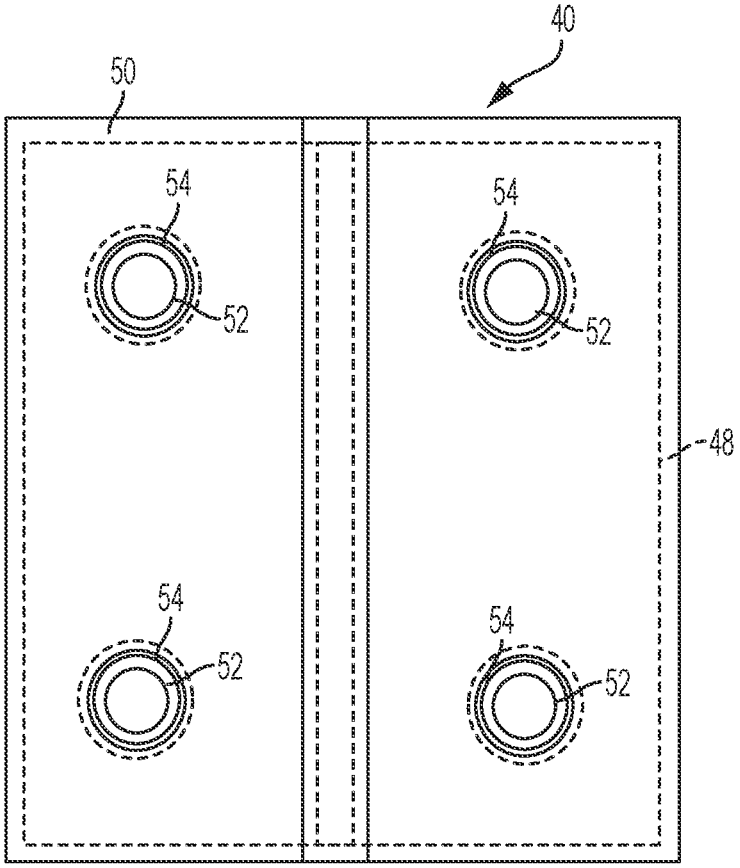
Fig. 6 PRIOR ART
FIG. 6 is a bottom plan view of the prior art gauge plate shown in FIG. 3.
Figure 7:
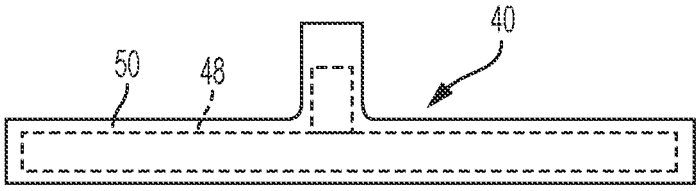
Fig. 7 PRIOR ART
FIG. 7 is an elevational view of the prior art gauge plate shown in FIG. 6.
Figure 8:
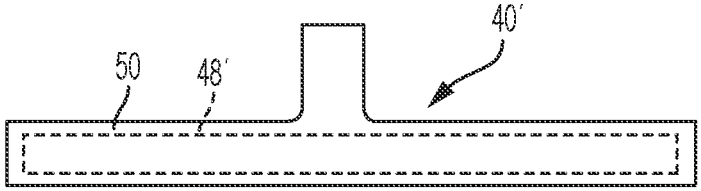
Fig. 8 PRIOR ART
FIG. 8 is an elevational view of an example prior art gauge plate similar to that shown in FIG. 7 with a modified steel core.

The gauge plate insulator 70 shown in FIGS. 9A-9C can be used in replacement of the gauge plate insulator 40 shown in FIG. 3.

Figure 10A:
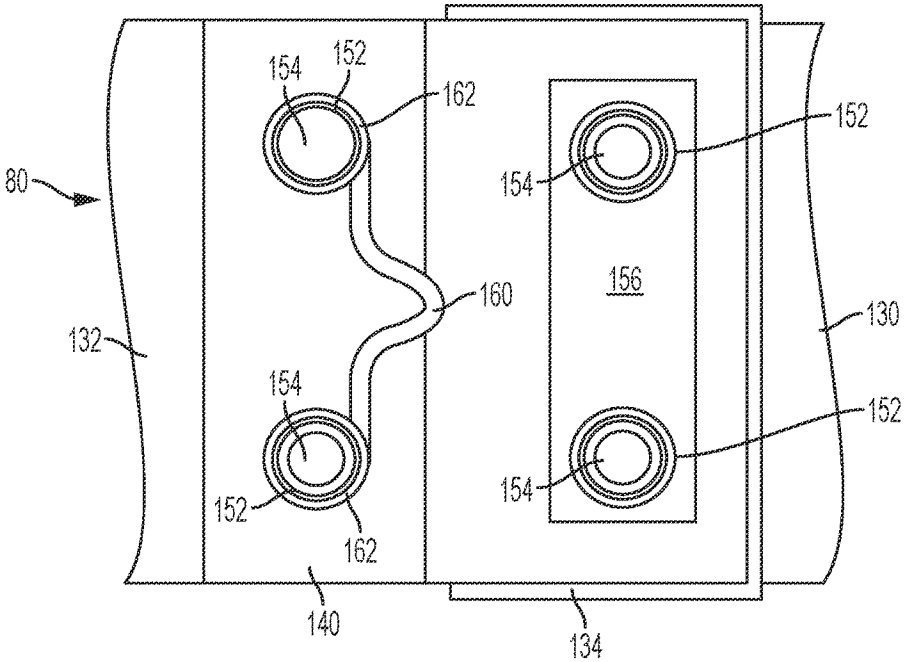
FIG. 10A is a top view of a gauge plate in accordance with a further embodiment of the present application.
Figure 10B:
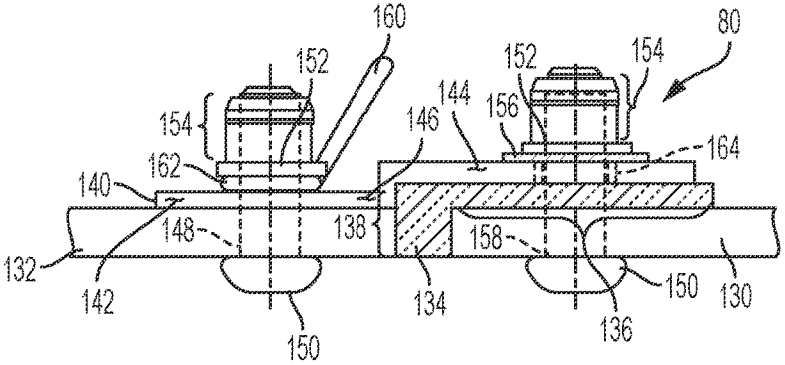
FIG. 10B is an elevational view of the gauge plate of FIG. 10A.

With reference to FIGS. 10A-10B, a gauge plate insulator assembly 80 according to a further embodiment includes an L-shaped insulator 134 separating metallic plates 130 and 132 which correspond to first and second members 42 and 44 shown in FIG. 3. L-shaped insulator 134 includes a leg 136 that rests atop of at least a part of the upper facing surface of gauge plate 130 and a base 138 that depends downwardly separating the facing ends of plates 130 and 132. A metallic backing plate 140 has a first part 142 that rests on an upward facing surface of plate 132, a second part 144 that rests on an upward facing surface of the leg 136 of insulator 134, and a third part 146 that transitions vertically between first part 142 and second part 144 along at least a part of base 138 of insulator 134.

The gauge plate insulator assembly 80 can include a number of fastener holes 148 that extend through gauge plate member 132 and first part 142 of backing plate 140. Each fastener hole 148 can receive the shaft of a Huck pin 150 which can be secured in place via a flat washer 152 and a Huck collar 154 in a manner known in the art.

An insulating plate 156 can be positioned on a surface of second part 144 of backing plate 140 that faces away from plate 130. The gauge plate insulator assembly 80 can also include a number of fastener holes 158 that extend through plate 130, leg 136 of insulator 134, second part 144 of backing plate 140, and insulating plate 156. Each fastener hole 158 can receive the shaft of a Huck pin 150 and can be secured in place via a flat washer 152 and a Huck collar 154.

The gauge plate insulator assembly 80 shown in FIGS. 10A-10B can include a lifting bail 160 that includes parts 162 on either end that can be sandwiched between flat washers 152 and first part 142 of backing plate 140. The fastener holes 158 may include insulated bushings 164 in order to electrically isolate plates 130 and 132 from each other.

The gauge plate insulator assembly 80 shown in FIGS. 10A-10B can be used in replacement of the gauge plate 40 shown in FIG. 3.

Figure 11A:
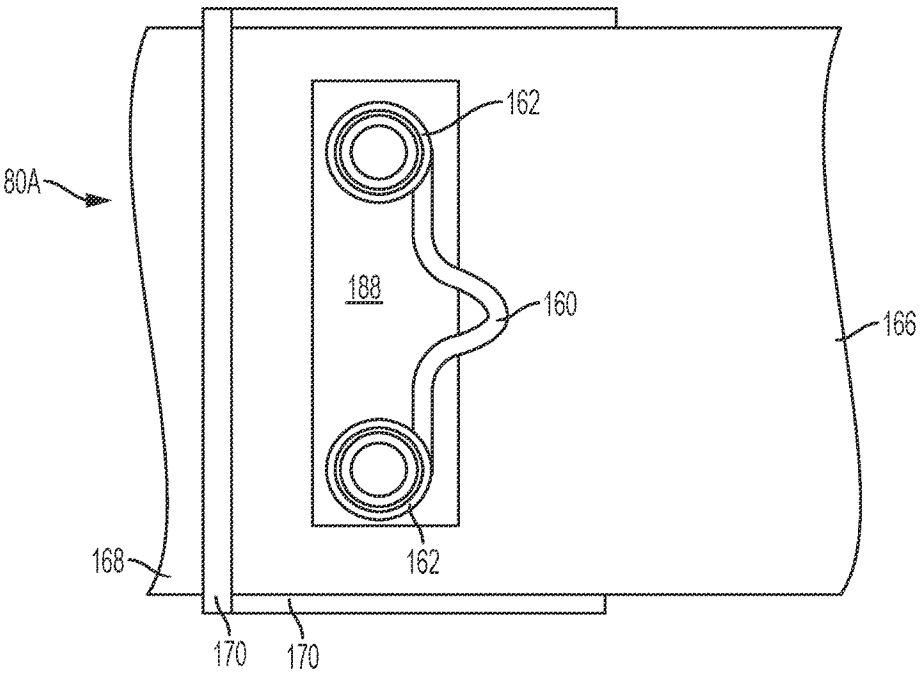
FIG. 11A is a top view of a gauge plate in accordance with a further embodiment of the present application.
Figure 11B:
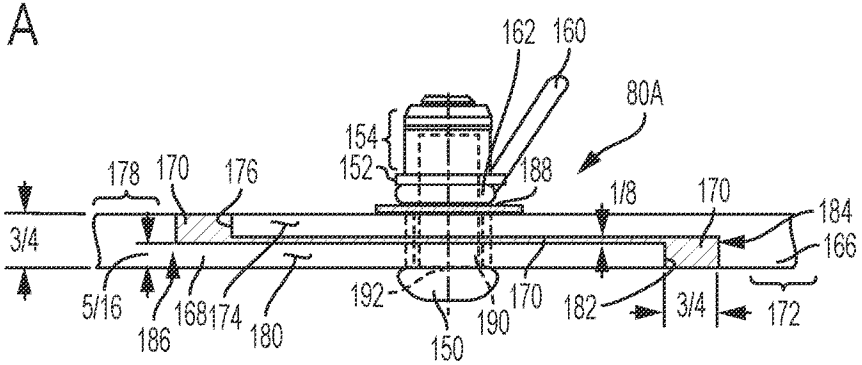
FIG. 11B is an elevational view of the gauge plate of FIG. 11A.

With reference to FIGS. 11A-11B, a gauge plate assembly 80A according to a further embodiment includes metallic plates 166 and 168 having an insulator 170 sandwiched therebetween. In this example, plates 166 and 168 can replace first and second members 42 and 44 shown in FIG. 3. Plate 166 includes a thick section 172 and a thin section 174 adjacent an end 176 of plate 166. Similarly, plate 168 includes a thick section 178 and a thin section 180 adjacent an end 182 of plate 168. The boundary between thick section 172 and thin section 174 of plate 166 is defined by a step 184 while the boundary between thick section 178 and thin section 180 of plate 168 is defined by a step 186. Plates 166 and 168 are oriented such that steps 184 and 186 face in opposite direction with the thin section 174 positioned above thin section 180 with a sheet-like portion of insulator 170 disposed therebetween. A portion of the thin section 174 of the plate member 166 overlaps with a portion of the thin section 180 of the plate member 168.

Between thin sections 174 and 180 positioned as shown in FIG. 11B, insulator 170 can be a flat sheet having a thickness of, e.g., ⅛ inch. However, adjacent to step 186, insulator 170 can include a thicker portion that fills the gap between end 176 and the vertical wall of step 186. Similarly, adjacent to step 184, insulator 170 can include a thicker portion that fills the gap between end 182 and the vertical surface of step 184. In an example, each thicker portion of insulator 170 can have a thickness of, e.g., 7⁄16 inch.

An insulating plate or washer 188 can be positioned on a surface of thin section 174 facing away from insulator 170. This example gauge plate can include a pair of fastener holes 190 each of which extends through thin sections 174 and 180, the plate-like portion of insulator 170 therebetween, and through insulating plate 188 for receiving the shaft of a Huck pin 150 which can be secured in place via a flat washer 152 and a Huck collar 154. The gauge plate assembly 80A can optionally include a lifting bale 160 that includes parts 162 that can be received between washers 152 and insulating plate 188. Each fastener hole 190 can receive an insulating bushing 192 to electrically insulate plates 166 and 168 from each other.

Figure 12A:
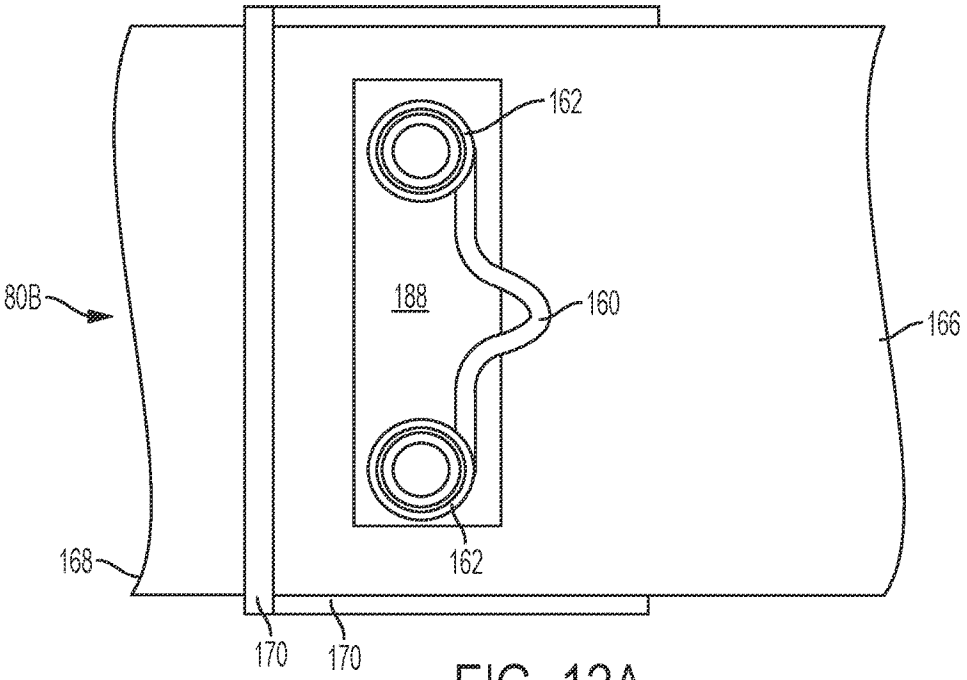
FIG. 12A is a top view of a gauge plate in accordance with a further embodiment of the present application.
Figure 12B:
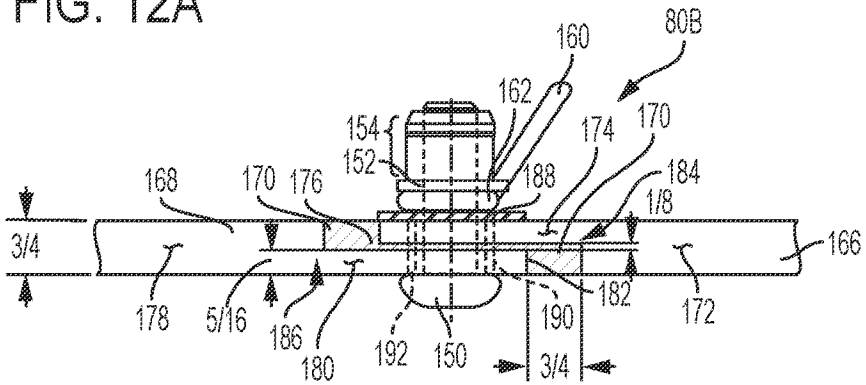
FIG. 12B is an elevational view of the gauge plate of FIG. 12A.

With reference to FIGS. 12A-12B, a gauge plate assembly 80B according to a further embodiment is similar in most respects to the gauge plate assembly 80A shown in FIGS. 11A and 11B with at least the following exceptions. The distances between steps 184 and 186 and ends 176 and 182, respectively, are shorter and consequently the sheet-like portion of insulator 170 between thin sections 174 and 180 can have less area. Because the distance between shoulder 184 and end 176 of thin section 174 is shorter, an edge of insulating plate or washer 188 can be positioned in alignment with end 176 of thin section 174.

Figure 13A:
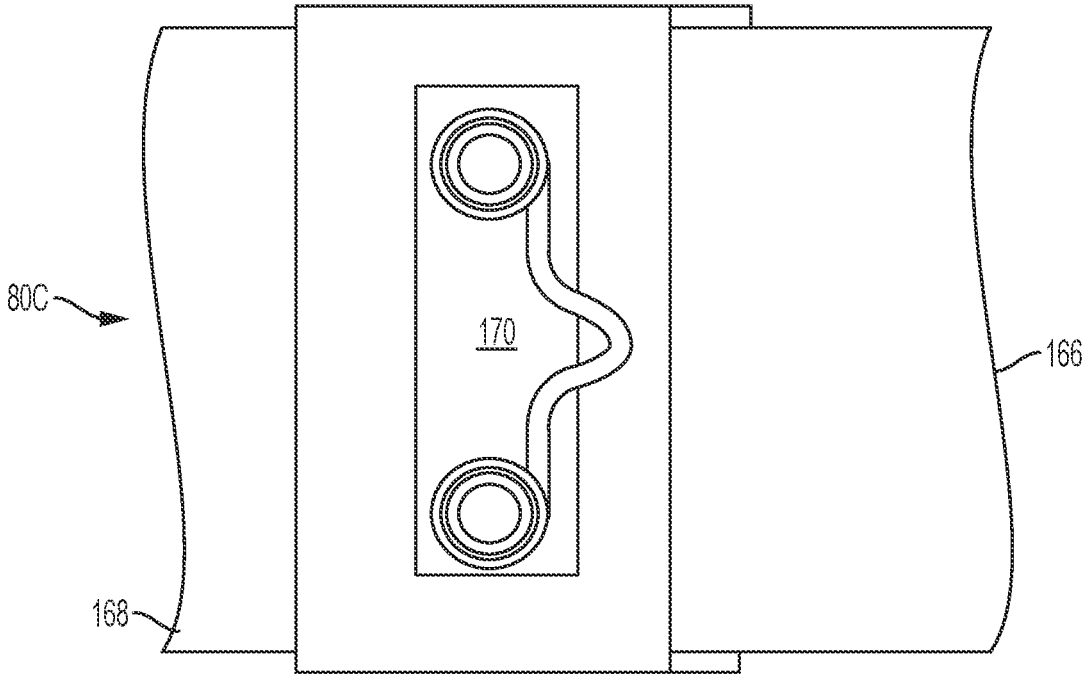
FIG. 13A is a top view of a gauge plate in accordance with a further embodiment of the present application.
Figure 13B:
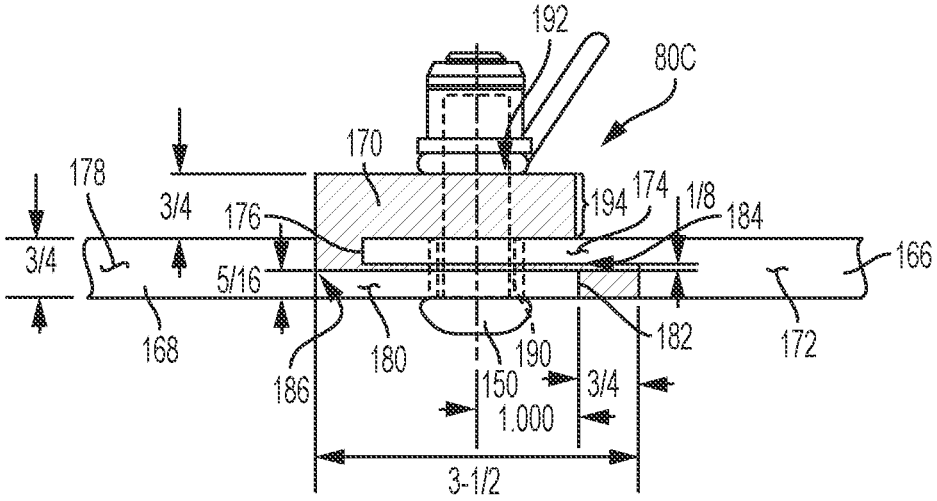
FIG. 13B is an elevational view of the gauge plate of FIG. 13A.

With reference to FIGS. 13A and 13B, a gauge plate assembly 80C according to a further embodiment is similar in most respects to the gauge plate 80B shown in FIGS. 12A-12B with at least the following exceptions. The insulating plate 188 shown in FIGS. 12A-12B can be replaced with a redesigned insulator 170 that includes a portion 194 that extends upward from step 186 away from thin section 180 and then extends in a direction (rightward in FIG. 12B) toward thick section 172 of plate 166.

In this example, each fastener hole 190 also extends through the portion 194 of insulator 170 that replaces insulating plate 188 in the example shown in FIGS. 12A-12B. Optionally, the height of insulating bushing 192 can be extended through the part of fastener hole 190 that extends through the portion 194 of insulator 170 shown in FIGS. 13A-13B.

Figure 14A:
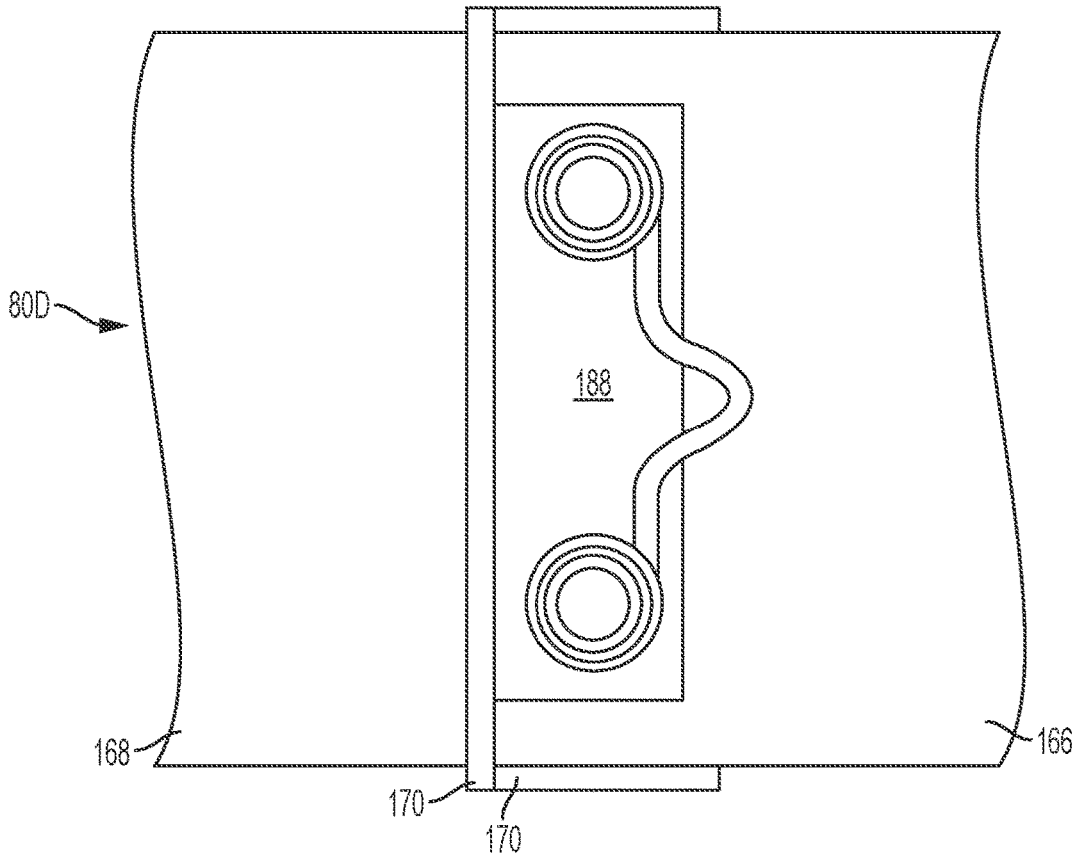
FIG. 14A is a top view of a gauge plate in accordance with a further embodiment of the present application.
Figure 14B:
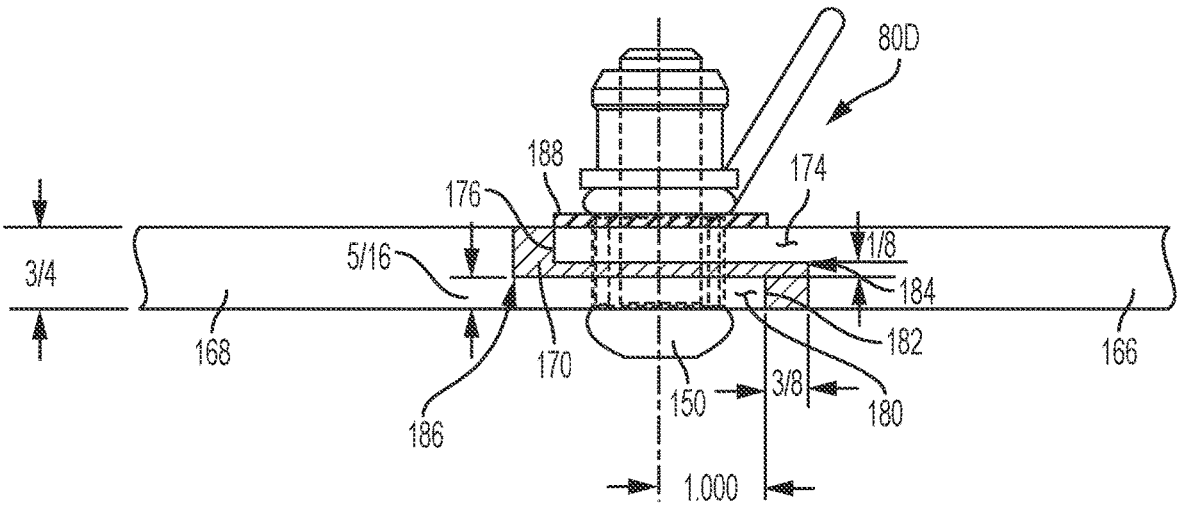
FIG. 14B is an elevational view of the gauge plate of FIG. 14A.

With reference to FIGS. 14A and 14B, a gauge plate assembly 80D according to a further embodiment is similar in most respects to the gauge plate assembly 80B shown in FIGS. 12A and 12B with at least the following exceptions. The distances between the vertical faces of shoulders 184 and 186 and the ends 182 and 176, respectively, of thin sections 180 and 174 can be reduced to ⅜ inch, as compared to ¾ inch shown in the gauge plate assembly 80B of FIGS. 12A-12B.

Figure 15A:
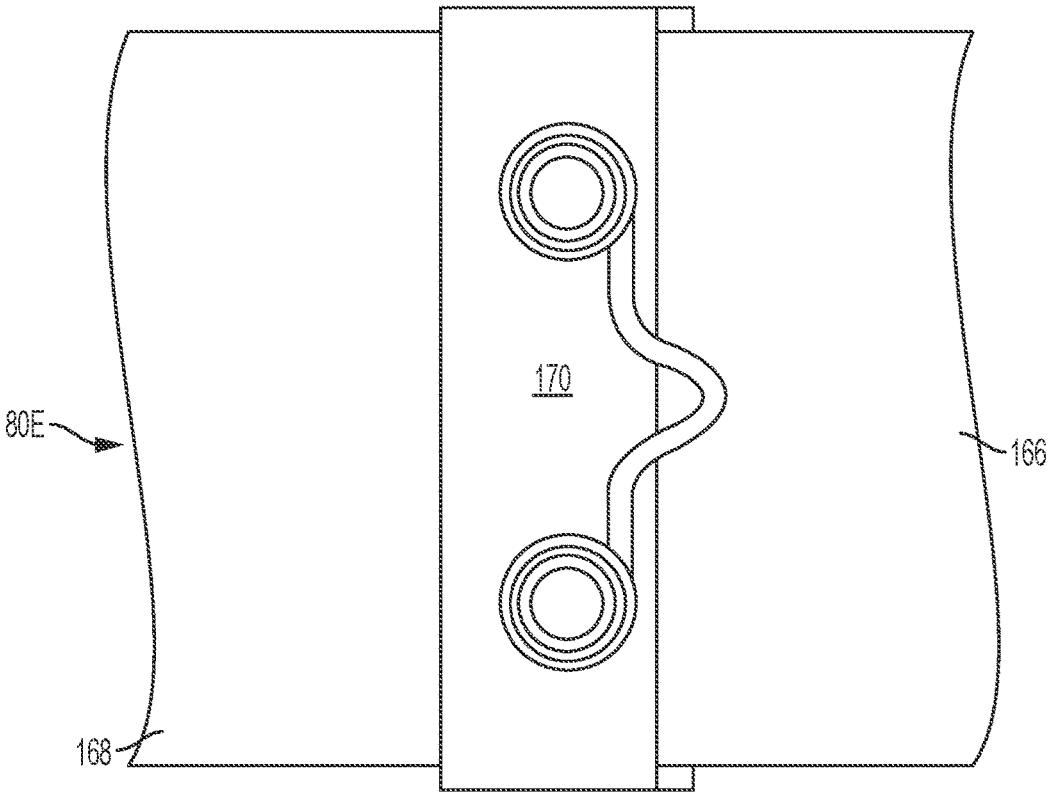
FIG. 15A is a top view of a gauge plate in accordance with a further embodiment of the present application.
Figure 15B:
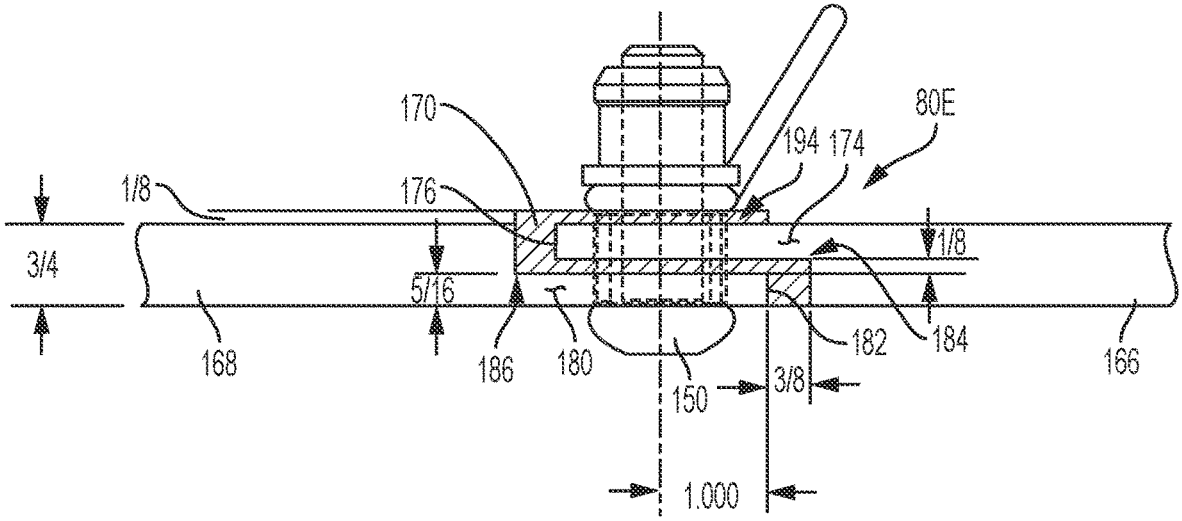
FIG. 15B is an elevational view of the gauge plate of FIG. 15A.

With reference to FIGS. 15A and 15B, a gauge plate assembly 80E according to a further embodiment is similar in most respects to the gauge plate assembly 80C shown in FIGS. 13A and 13B with at least the following exceptions. The thickness of portion 194 of insulator 170 is ⅛ inch as compared to ¾ inch in the gauge plate assembly 80C shown in FIGS. 13A and 13B. Also, the distances between the vertical walls of steps 184 and 186 and the ends 182 and 176, respectively, of thin sections 180 and 174 can be reduced to ⅜ inch versus ¾ inch in the gauge plate assembly 80C shown in FIGS. 13A-13B.

Figure 16A:
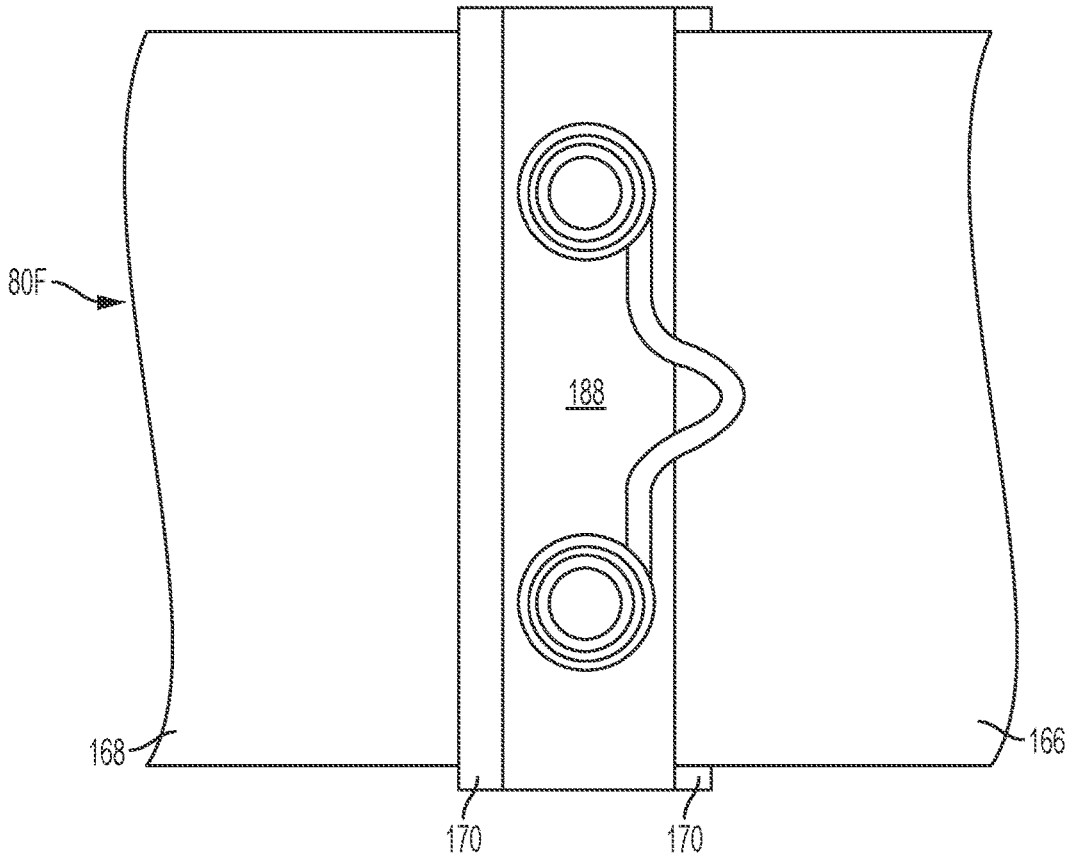
FIG. 16A is a top view of a gauge plate in accordance with a further embodiment of the present application.
Figure 16B:
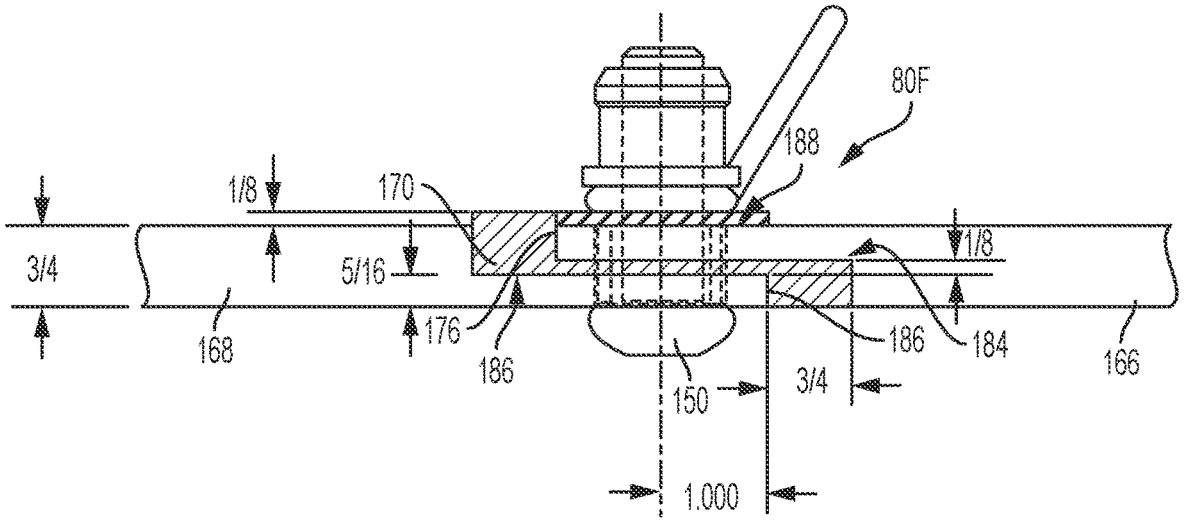
FIG. 16B is an elevational view of the gauge plate of FIG. 16A.

With reference to FIGS. 16*a* and 16B, a gauge plate assembly 80F according to a further embodiment is similar in most respects to the gauge plate assembly 80B shown in FIGS. 12A and 12B with at least the following exceptions. The height of insulator 170 between step 186 and end 176 is increased, e.g., by ⅛ inch, whereupon the upper facing surface of this section of insulator 170 is flush with the top of insulating plate or washer 188.

Figure 17A:
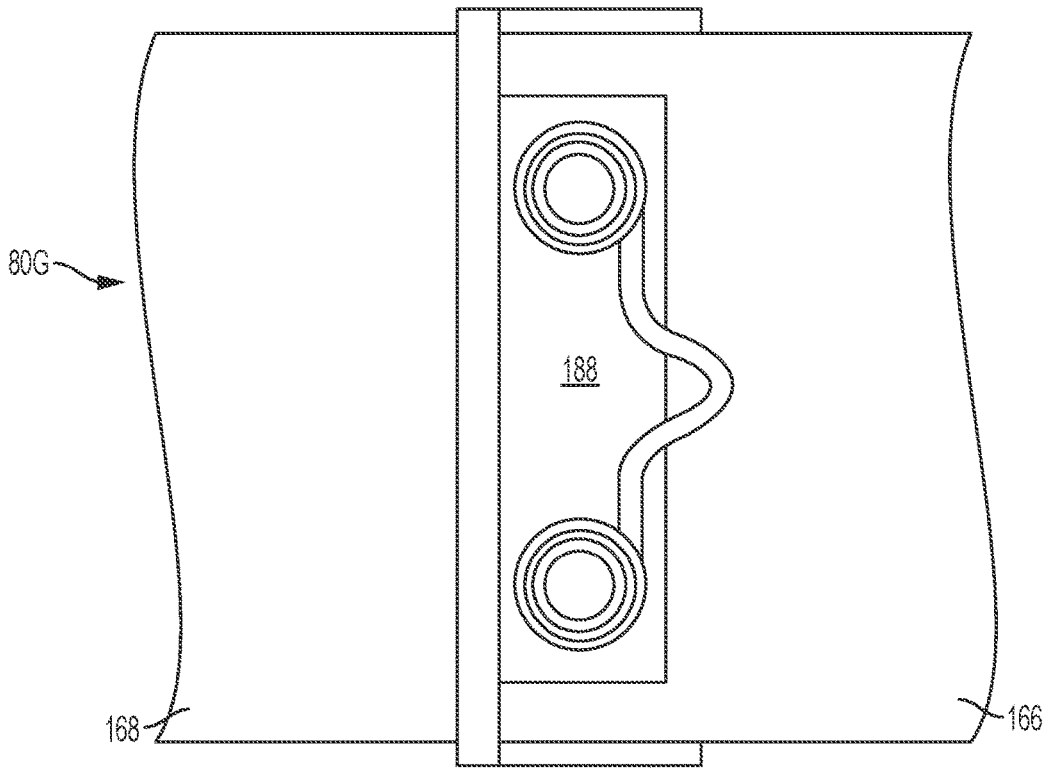
FIG. 17A is a top view of a gauge plate in accordance with a further embodiment of the present application.
Figure 17B:
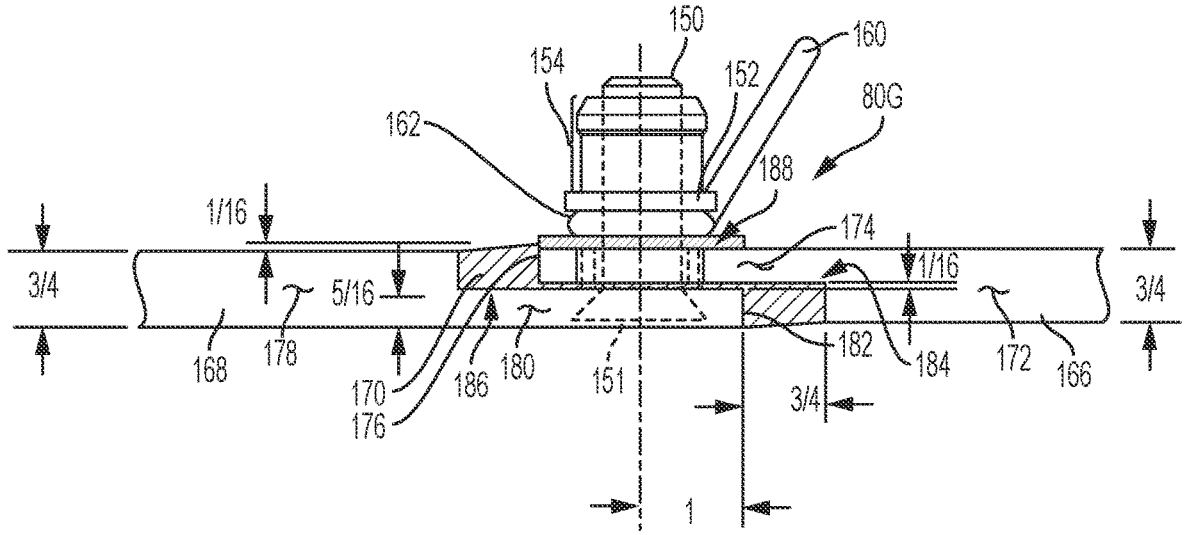
FIG. 17B is an elevational view of the gauge plate of FIG. 17A.

With reference to FIGS. 17A and 17B, a gauge plate assembly 80G according to a further embodiment is similar in most respects to the gauge plate assembly 80B shown in FIGS. 12A and 12B with at least the following exceptions. The sum of the thickness of thin sections 174 and 180 of plates 166 and 168, respectively, total the thickness of each thick section 172 and 174 of these plates. In this example, the thickness of the plate-like area of insulator 170 between thin sections 174 and 180 is 1/16 inch thick versus ⅛ inch thick in the example shown in FIGS. 12A and 12B. In addition, in order to account for the difference in height between end 176 and the vertical wall of step 186 when the sheet-like portion of insulation is disposed between thin sections 174, 180, the section of insulator between end 176 and the vertical wall of step 186 is tapered so as to cover both vertical surfaces of end 176 and step 186 without having part of insulator 170 extend above or below either surface. Similar comments apply in respect of the section of insulator 170 between end 182 and step 184. Moreover, in this example, the head 151 of Huck pin 150 is in the form of a countersink (tapered) head that is received in a corresponding countersink opening in thin section 180 of plate 168. The use of a fastener with a countersink head avoids the heads of fasteners 150 shown, for example, in FIGS. 12A-12B, from extending from a side, e.g., the bottom, of the corresponding gauge plate.

With reference to FIGS. 18A-18D, a gauge plate assembly 80H according to a further embodiment includes a single metallic core 100 surrounded by an electrically insulating material 106. In this example, the electrically insulating material 106 can be a single or multi-layer insulator. In an example, the surface of metallic core 100 facing away from metallic plates 130, 132 can be covered by a fiberglass insulator while the remaining portions, i.e., the sides and surface of metallic plate 100 facing plates 130, 132, can be covered by an electrically insulating epoxy, although other suitable arrangements may be utilized. Instead of the depending leg 112 shown in FIGS. 9A-9C, the gauge plate assembly 80H shown in FIGS. 18A-18D can include a portion 196 of the insulating material 106 e.g., the electrically insulating epoxy, that depends from metallic core 100 and which surrounds, at least partially conformingly, a cylindrical structure 198, such as a PVC pipe, that extends between the facing ends of plates 130 and 132.

Figure 18A:
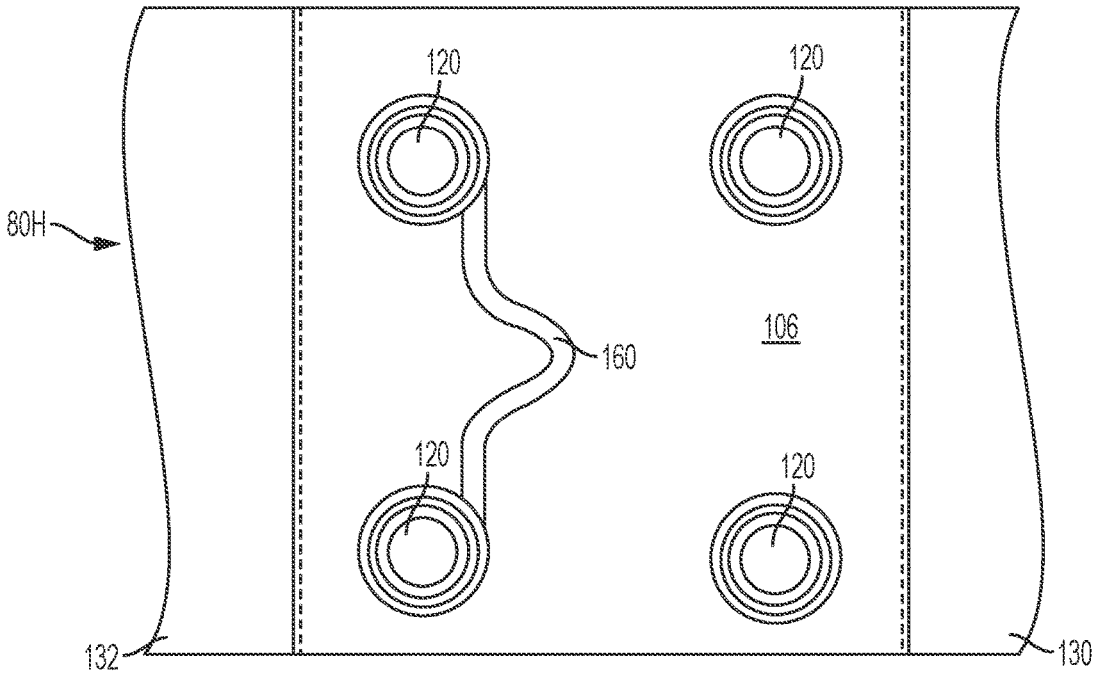
FIG. 18A is a top view of a gauge plate in accordance with a further embodiment of the present application.
Figure 18B:
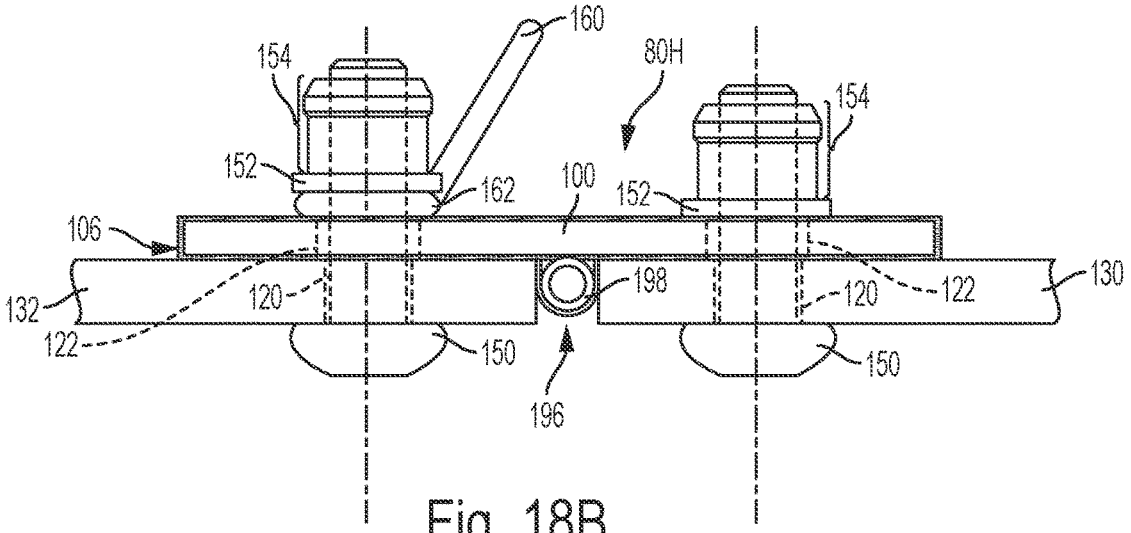
FIG. 18B is an elevational view of the gauge plate of FIG. 18A.
Figure 18C:
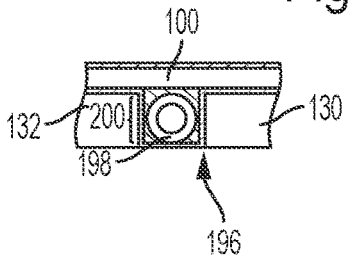
FIG. 18C is a partial elevational view of the gauge plate of FIG. 18A according to a further embodiment of the present application.
Figure 18D:
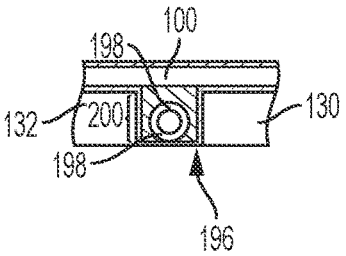
FIG. 18D is a partial elevational view of the gauge plate of FIG. 18A according to a further embodiment of the present application.

FIGS. 18C and 18D show two variations of the gauge plate assembly 80H shown in FIG. 18B. In FIG. 18C, the electrically insulating material 106 is in the form of a hollow T-shaped cross-section 200 with cylindrical structure 198 disposed in said hollow portion. In the example shown in FIG. 18C, the cylindrical structure extends between and contacts the inner surface of insulating material 106 disposed on the facing ends of plates 130 and 132. In the example shown in FIG. 18D, the cylindrical structure has a smaller diameter than the distance between the insulating material 106 disposed on the facing ends of plates 130 and 132. This additional spacing can account for expansion of plates 130 and 132 while maintaining electrical isolation therebetween.

The gauge plate assembly 80H shown in FIGS. 18A-18D can include four fastener holes 120 in the same pattern as the fastener holes shown in FIG. 9A. Each fastener hole 120 can extend through plate 130 or 132, metallic core 100, and insulating material 106 surrounding metallic core 100. Each fastener hole 120 can be configured to receive the shaft of a Huck pin 150 which can be secured in place by a flat washer 152 and a Huck collar 154 in a manner known in the art. An optional lifting bale 160 can be provided including parts 162 that can be positioned or sandwiched between the pair of washers 152 and a top surface of the electrically insulating material 106 surrounding metallic core 100. Finally, an insulating bushing 122 can be received in the portion of each fastener hole 120 that extends through metallic core 100 in order to insulate metallic core 100 from each plate 130 and 132.

Figure 19A:
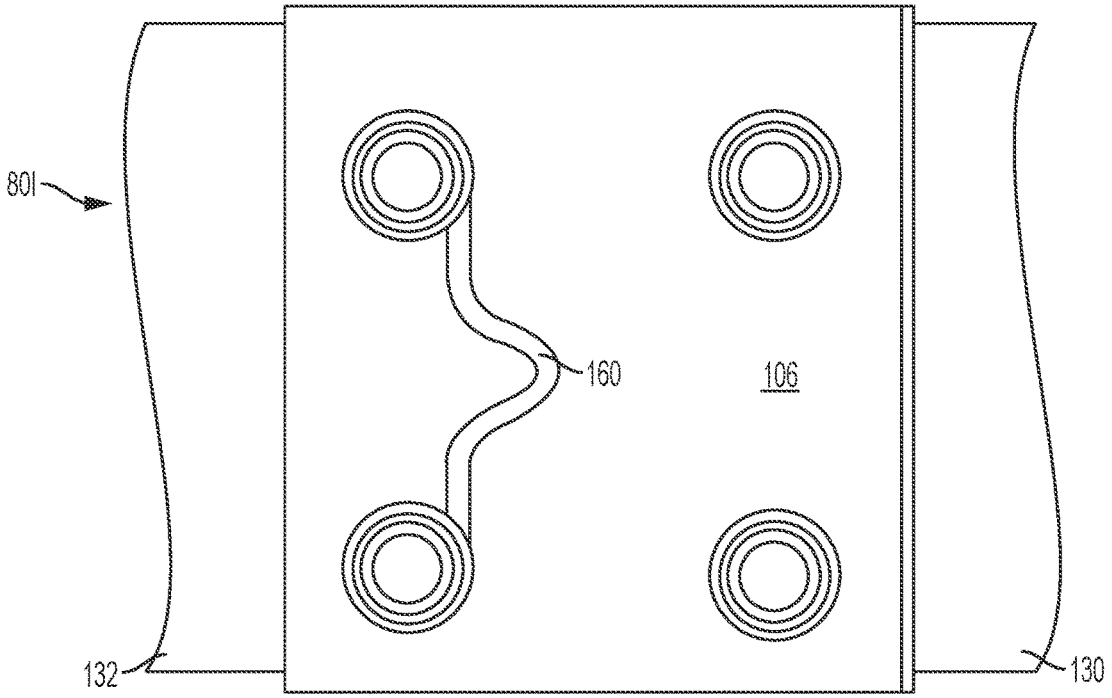
FIG. 19A is a top view of a gauge plate in accordance with a further embodiment of the present application.
Figure 19B:
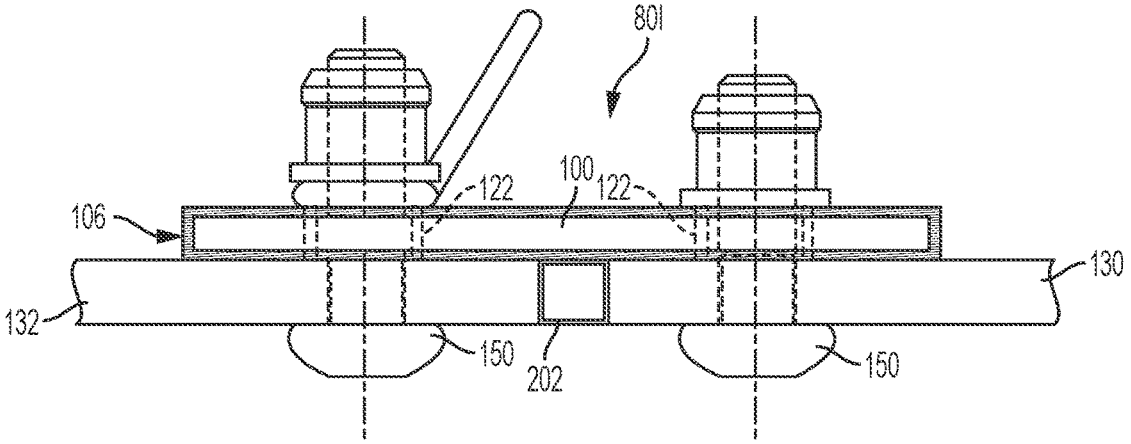
FIG. 19B is an elevational view of the gauge plate of FIG. 19A.

With reference to FIGS. 19A-19B, a gauge plate assembly 801 according to a further embodiment is similar in most respects to the gauge plate assembly 80H shown in FIGS. 18A-18D with at least the following exceptions. The portions 196 of the hollow electrically insulating material 106 shown in FIGS. 18A-18D can be omitted whereupon metallic core 100 and electrically insulating material 106 can be plate-shaped, and an elongated insulating structure 202, such as an elongated PVC pipe or tube, can be positioned between the facing ends of plates 130 and 132. In this example, structure 202 can be square or rectangular and can have a solid or hollow center.

Figure 20A:
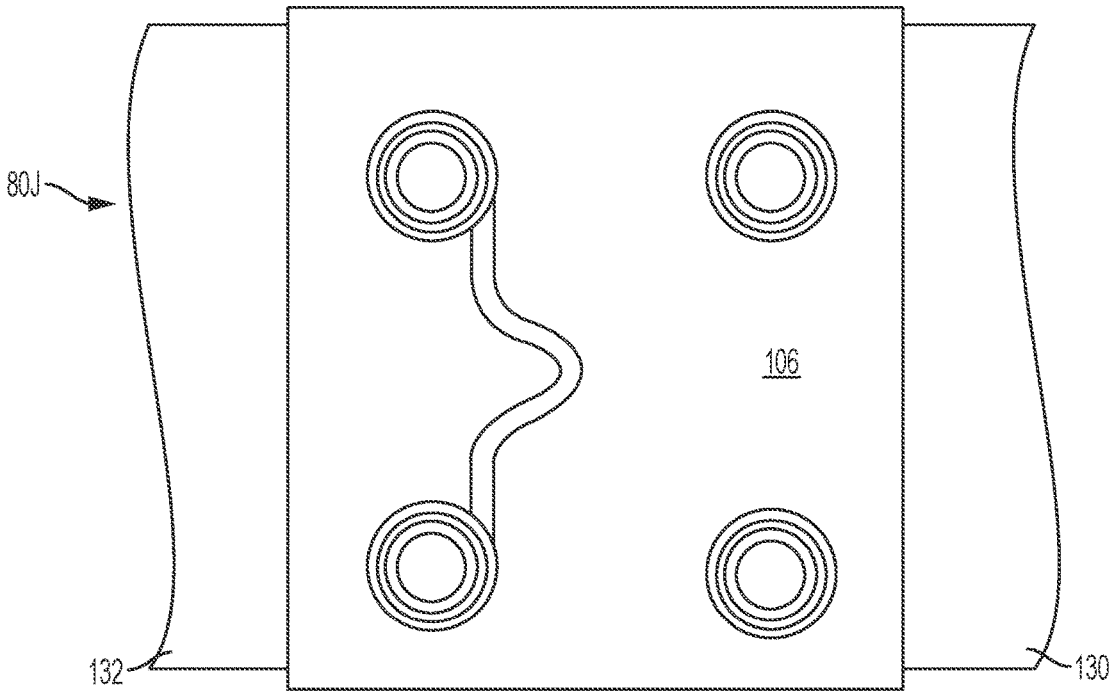
FIG. 20A is a top view of a gauge plate in accordance with a further embodiment of the present application.
Figure 20B:
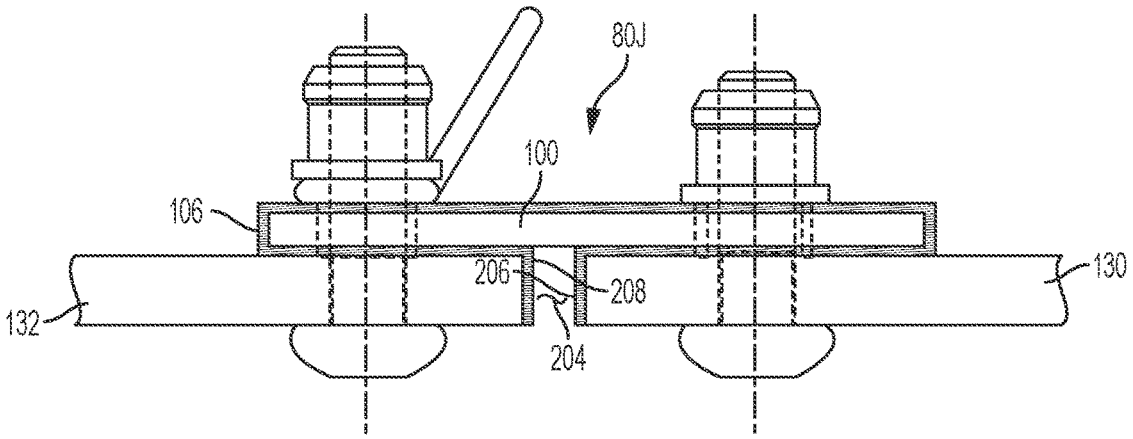
FIG. 20B is an elevational view of the gauge plate of FIG. 20A.

With reference to FIGS. 20A-20B, a gauge plate assembly 80J according to a further embodiment is similar in most respects to the gauge plate assembly 80H shown in FIGS. 18A-18D with at least the following exceptions. The metallic core 100 includes its top and side surfaces surrounded by insulator 106. However, in this example, the portion of metallic core 100 above a gap 204 between the facing surfaces of plates 130 and 132 is left uncovered by insulating material 106 and insulating material 106 covers the facing ends 206 and 208 of plates 130 and 132.

Figure 21A:
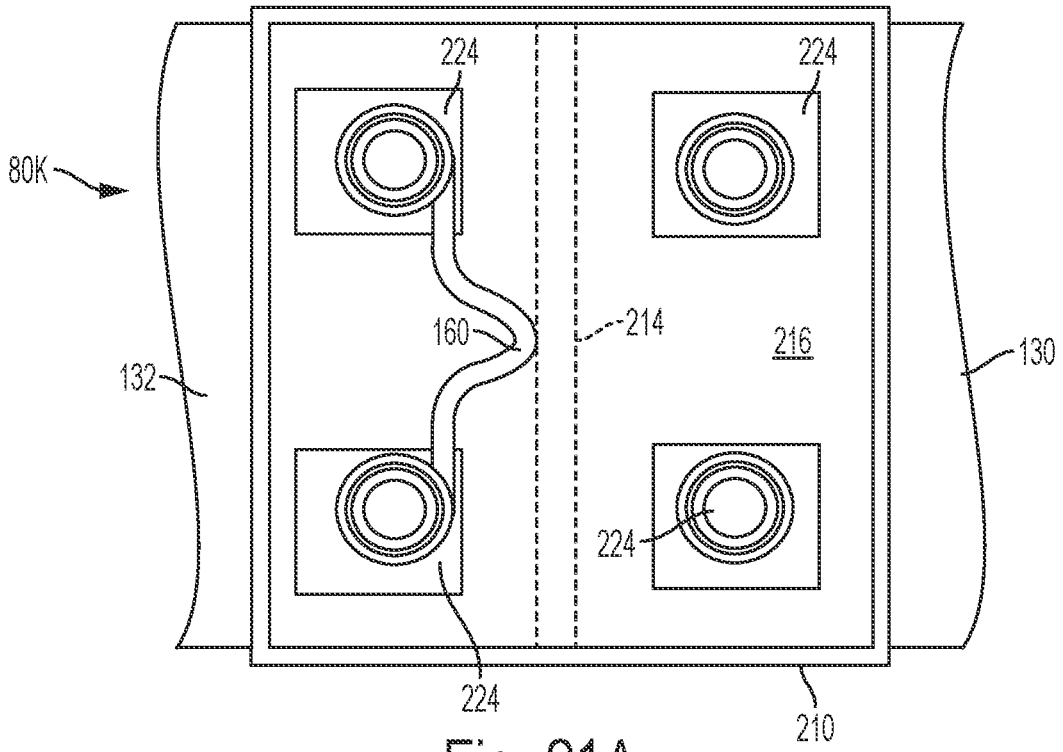
FIG. 21A is a top view of a gauge plate in accordance with a further embodiment of the present application.
Figure 21B:
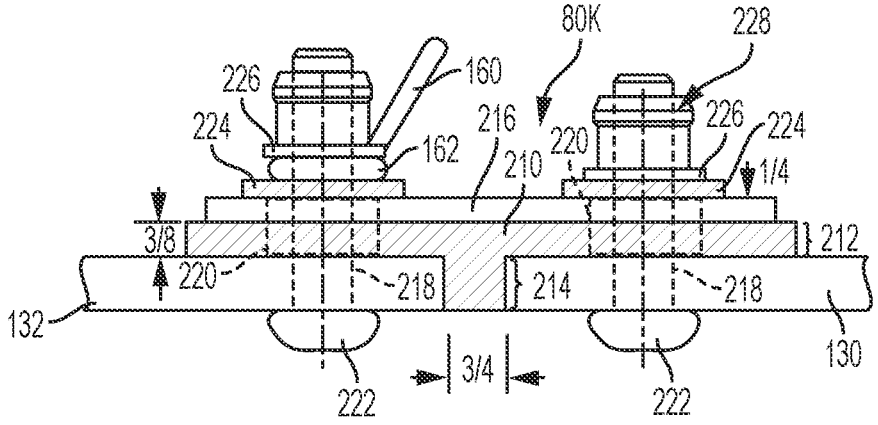
FIG. 21B is an elevational view of the gauge plate of FIG. 21A.

With reference to FIGS. 21A-21B, a gauge plate assembly 80K according to a further embodiment includes a T-shaped insulating plate 210 (shown in cross-section in FIG. 21B) that includes a planar body 212 and a depending leg 214 that has generally the same shape as the depending leg 112 shown in FIGS. 9A-9C. A metallic plate 216 is positioned on a side of body 212 of insulating plate 210 opposite depending leg 214. In the illustrated example, metallic plate 216 is received completely within the perimeter of insulating plate 210, although other suitable arrangements may be utilized.

A plurality of fastener holes 218 extends through plates 130 and 132, insulating plate 210, and metallic plate 216. An insulating bushing 220 can be received in each fastener hole 218, at least in the portion of fastener hole 218 defined by metallic plate 216, to isolate the shaft of the Huck pin 222 projected through the fastener hole 218 from metallic plate 216. Each Huck pin 222 can be secured in its respective fastener hole 218 via an insulating washer 224 received on the shaft of Huck pin 222 and in contact with a surface of metallic plate 216 opposite insulating plate 210, a flat washer 226 disposed on a side of insulating washer 224 opposite metallic plate 216, and a Huck collar 228 received on the threaded end of the shaft of the Huck pin 222 on a side of flat washer 226 opposite insulating washer 224. An optional lifting bale 160, including parts 162, can be provided, with each part 162 sandwiched between an insulating washer 224 and a flat washer 226. In the illustrated example, insulating washers 224 are square or rectangular. However, this is not to be construed in a limiting sense.

Figure 22A:
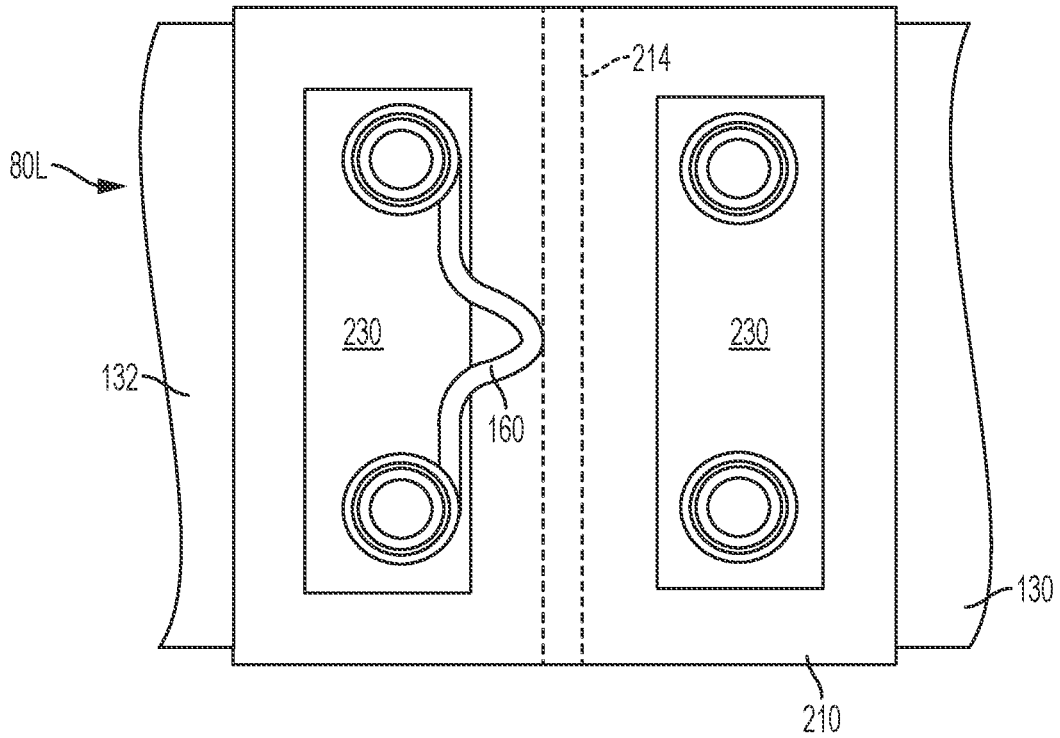
FIG. 22A is a top view of a gauge plate in accordance with a further embodiment of the present application.
Figure 22B:
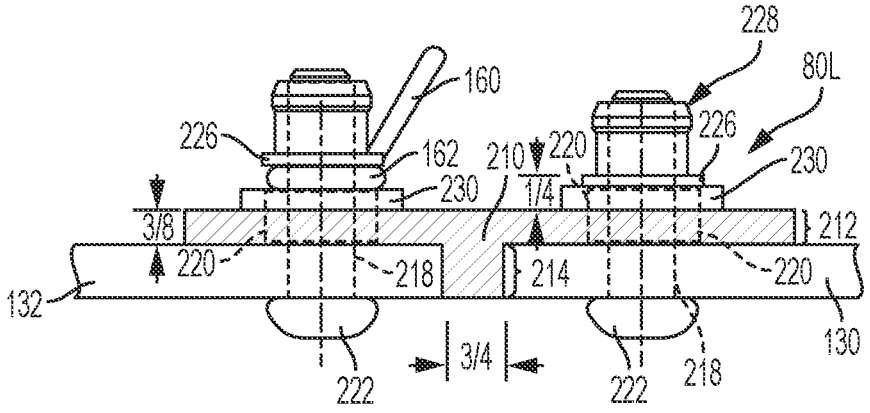
FIG. 22B is an elevational view of the gauge plate of FIG. 22A.

With reference to FIGS. 22A-22B, a gauge plate assembly 80L according to a further embodiment is similar in most respects to the gauge plate shown in FIGS. 21A-21B with at least the following exceptions. Instead of the single metallic plate 216 shown in FIGS. 21A-21B, the gauge plate assembly 80L shown in FIGS. 22A-22B includes a pair of elongated metallic plates 230 positioned in spaced relation on opposite sides of depending leg 214 of insulating plate 210. As can be seen, the elongated axis of each plate 230 runs generally in the same direction as the elongated length of depending leg 214.

Because the pair of plates 230 are spaced from each other, the insulating washers 224 shown in FIGS. 21A-21B can be omitted in the gauge plate assembly 80L shown in FIGS. 22A-22B.

Figure 23A:
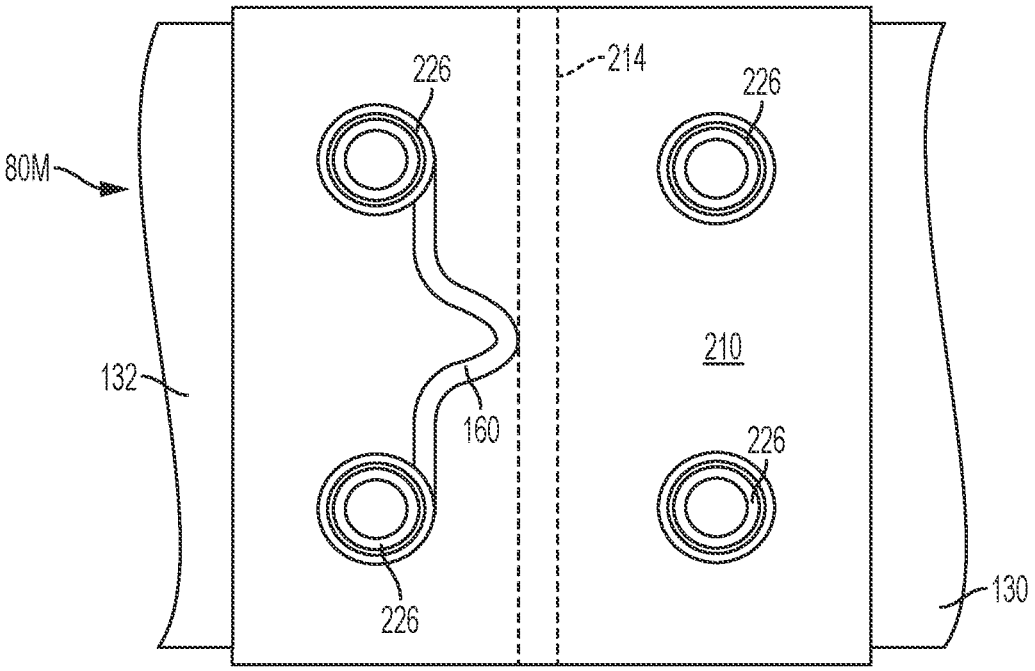
FIG. 23A is a top view of a gauge plate in accordance with a further embodiment of the present application.
Figure 23B:
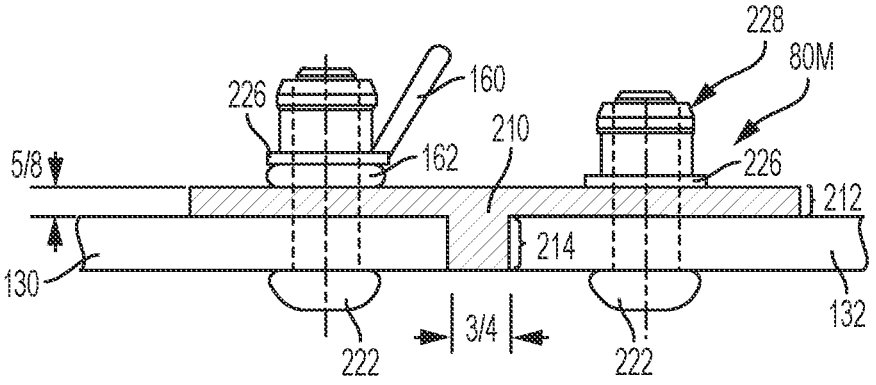
FIG. 23B is an elevational view of the gauge plate of FIG. 23A.

With reference to FIGS. 23A-23B, a gauge plate assembly 80M according to a further embodiment is similar in many respects to the gauge plate assembly 80L shown in FIGS. 22A-22B with at least the following exceptions. The thickness of the body 212 of insulator 210 is increased to ⅝ inch versus ⅜ inch in FIGS. 22A-22B and metallic plates 230 and bushings 220 of the gauge plate assembly 80L shown in FIGS. 22A-22B are omitted in the gauge plate assembly 80M shown in FIGS. 23A-23B.

Figure 24A:
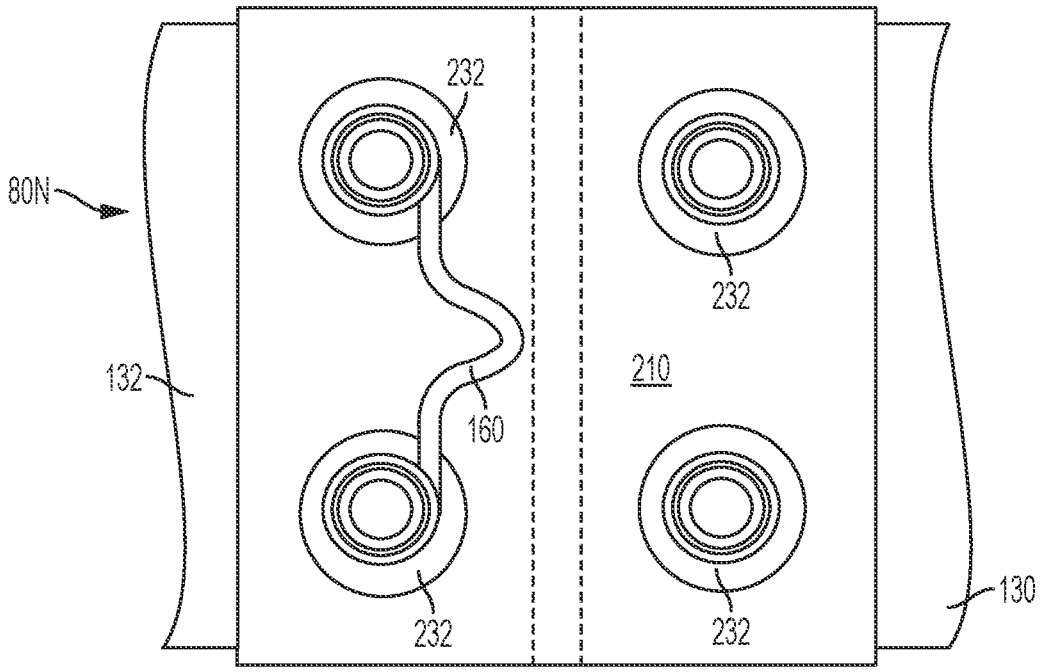
FIG. 24A is a top view of a gauge plate in accordance with a further embodiment of the present application.
Figure 24B:
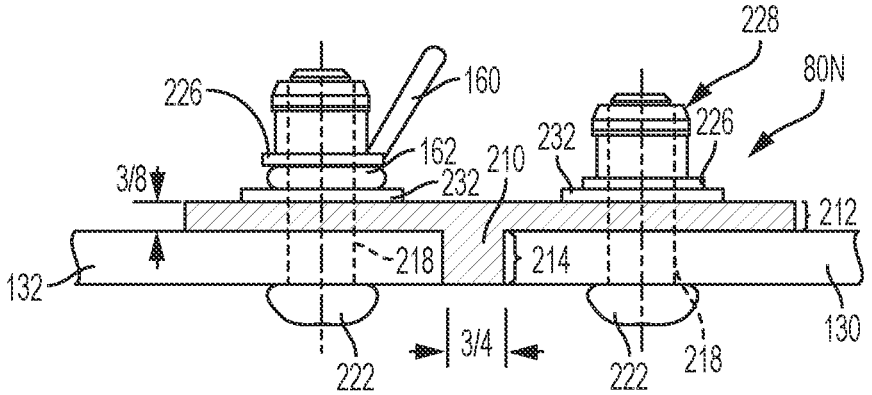
FIG. 24B is an elevational view of the gauge plate of FIG. 24A.

With reference to FIGS. 24A-24B, a gauge plate assembly 80N according to a further embodiment is similar in most respects to the gauge plate shown in FIGS. 22A-22B with at least the following exceptions. The metallic plates 230 shown in FIGS. 22A-22B are replaced in the gauge plate assembly 80N shown in FIGS. 24A-24B with metallic washers 232 and with one metallic washer 232 for each Huck pin 222. As can be seen, metallic washers 232 are spaced from each other and are electrically isolated from each other by insulating plate 210. Because of this electrical isolation, insulating bushings 220 shown, for example, in FIGS. 21A-21B, are not required.

Figure 29:
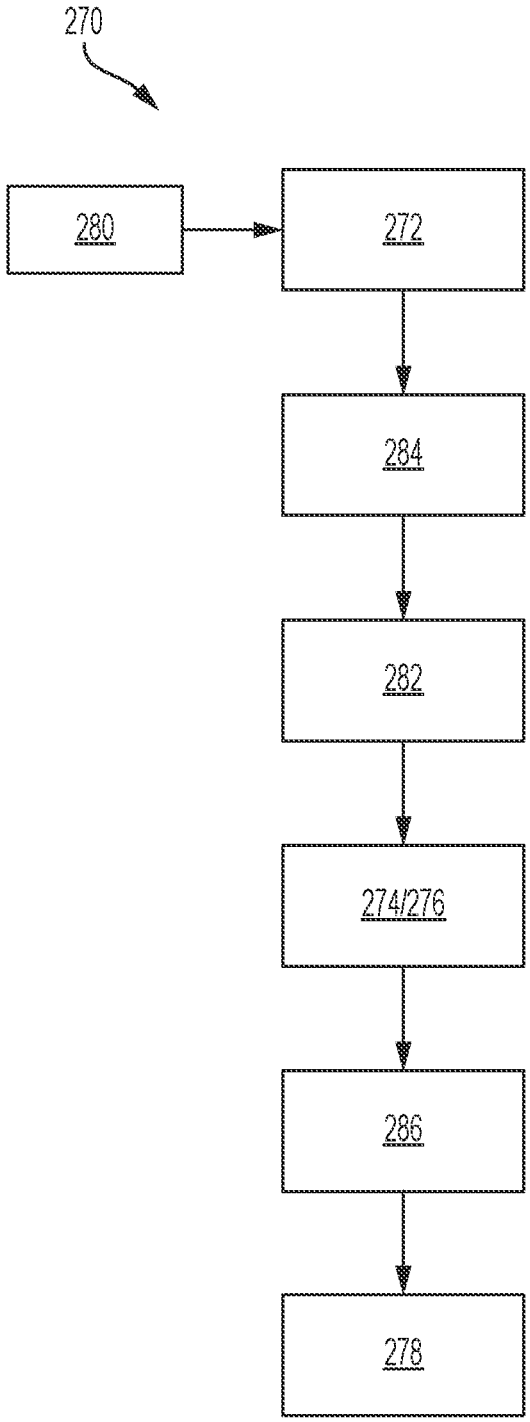
FIG. 29 is a schematic view of a method of manufacturing a gauge plate insulator according to one embodiment of the present application.

Referring to FIG. 29, the insulating plate 210 of the gauge plate assemblies 80K-80N shown in FIGS. 21A-24B may be formed utilizing a pultrusion process. In particular, the insulating plate 210 may be integrally formed from a fiber-reinforced polymer using the pultrusion process. According to one aspect or example, a method 270 for manufacturing the insulating plate 210 includes impregnating a fiber reinforcement with resin 272; pulling the fiber reinforcement impregnated with the resin through a forming die 274 to form a profile of the insulating plate 210; heating the profile to cure the resin 276; and cutting the profile to a predetermined length 278. The fiber reinforcement may be fiberglass, such as E-class fiberglass or S-class fiberglass, although other suitable reinforcing fibers and combinations may be utilized. The resin may be polyester, vinyl ester, polyurethane, or epoxy, although other suitable resins and combinations may be utilized. During the resin impregnation step, a catalyst may be mixed with the resin to facilitate the curing of the resin. Other suitable pigments and fillers may also be utilized in connection with the resin and reinforcing fiber.

The reinforcing fiber may be provided from a reinforcement supply 280, which may include rovings of fiber or rolls of fiber mat. Before and/or after the reinforcing fiber is impregnated with the resin, the reinforcing fiber may undergo a preforming process 282 to preform the reinforcing fiber to prepare the reinforcing fiber for the forming process. After the fiber reinforcement is impregnated with the resin, the method may include applying a surfacing veil 284 to the fiber reinforcement. The forming and heating step 274, 276 may occur simultaneously with a heat source being provided as the fiber reinforcement and resin pass through the forming die, although other suitable arrangements may be utilized. As noted above, the method 270 includes pulling 286 the fiber reinforcement through a forming die, which may be accomplished using any suitable pulling system, such as a caterpillar-style system or reciprocating system. The cutting step 278 may be accomplished via a cut-off saw, although other suitable arrangements may be utilized.

Although the method 270 is described in connection with the insulating plate 210, the method 270 may be utilized in connection with other components and elements of the present application.

Figure 25A:
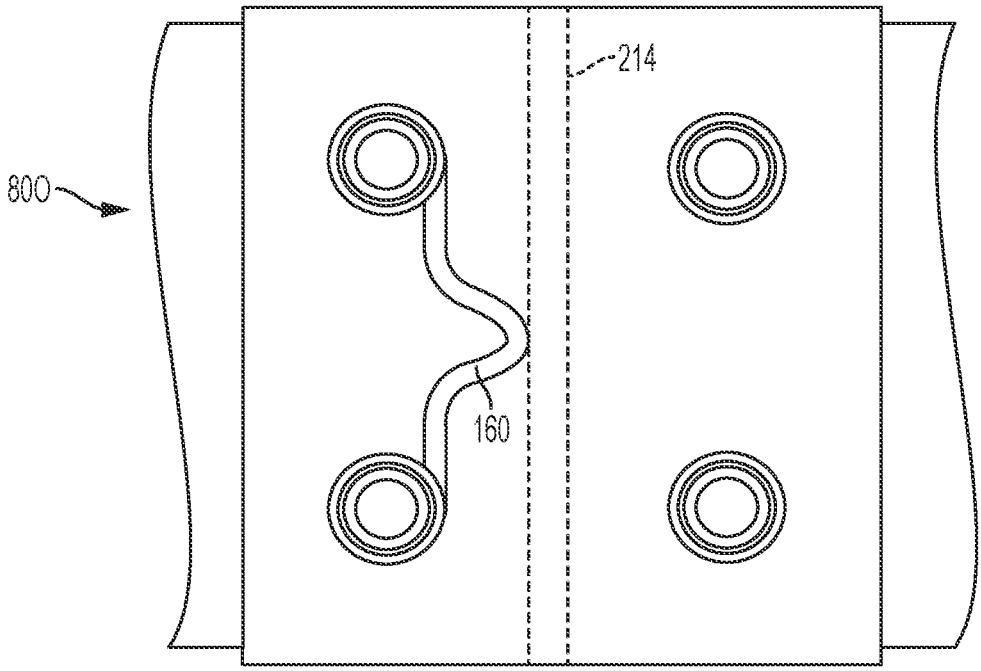
FIG. 25A is a top view of a gauge plate in accordance with a further embodiment of the present application.
Figure 25B:
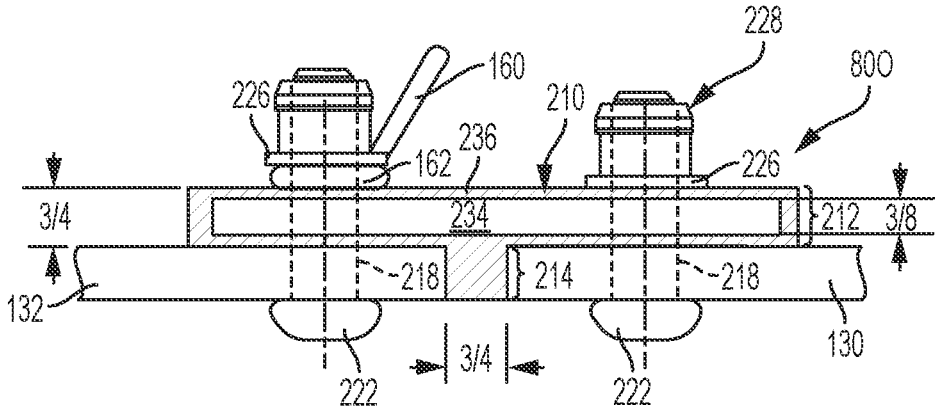
FIG. 25B is an elevational view of the gauge plate of FIG. 25A.

With reference to FIGS. 25A-25B, a gauge plate assembly 80O according to a further embodiment is similar in many respects to the gauge plate assembly 80M shown in FIGS.

23A-23B with at least the following exceptions. In the gauge plate assembly 80O shown in FIGS. 25A-25B, the thickness of body 212 is increased to ¾ inch from ⅝ inch shown in FIGS. 23A-23B. In addition, insulating plate 210 is formed with a core 234 of a glass fabric impregnated with epoxy resin, e.g., the well-known G10 laminate, encased in an insulating material 236, e.g., polyethylene. The insulating material 236 encasing core 234 also forms depending leg 214. Because core 234 and insulating material 236 of insulating plate 210 are both formed of insulating material, no bushings are required to insulate the shafts of Huck pins 222 from insulating plate 210 or plates 130, 132. In the illustrated example, core 234 has a thickness of ⅜ inch, although other suitable thicknesses may be utilized.

Figure 26A:
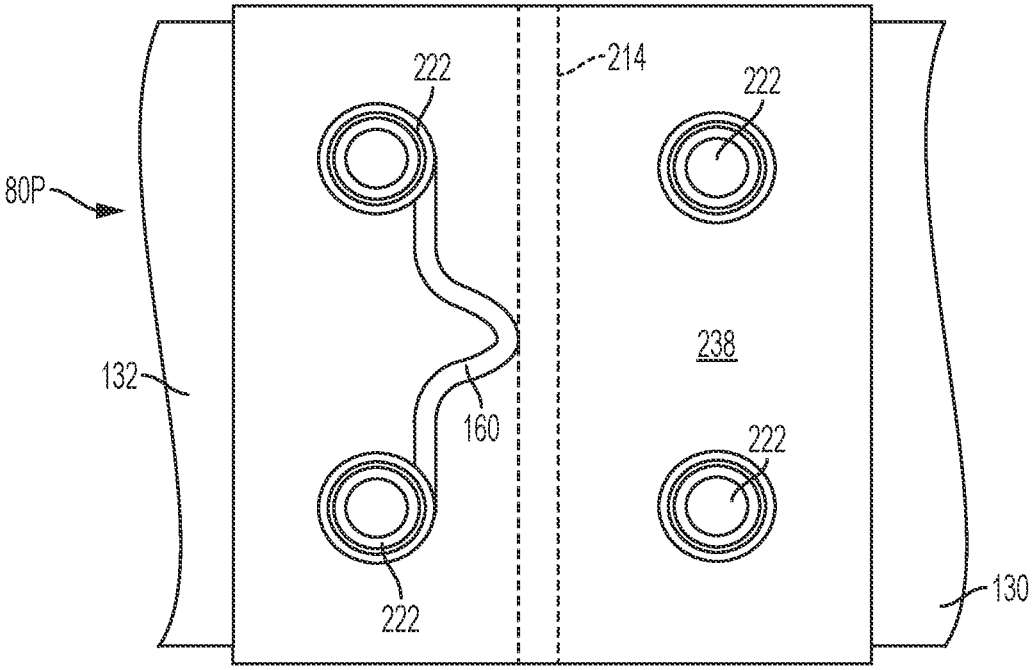
FIG. 26A is a top view of a gauge plate in accordance with a further embodiment of the present application.
Figure 26B:
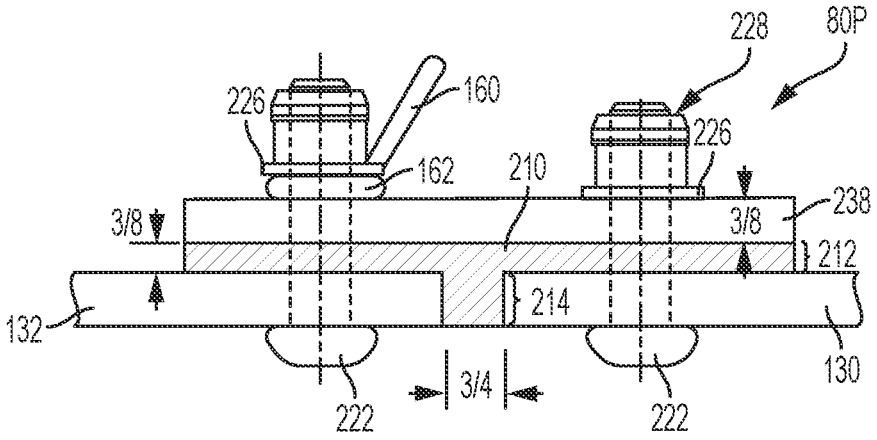
FIG. 26B is an elevational view of the gauge plate of FIG. 26A.

With reference to FIGS. 26A-26B, a gauge plate assembly 80P according to a further embodiment is similar in most respects to the gauge plate assembly 80M shown in FIGS. 23A-23B with at least the following exceptions. The thickness of body 212 of insulating plate 210 is set at ⅜ inch versus ⅝ inch shown in FIGS. 23A-23B. In addition, positioned between insulating plate 210 and washers 226 is an insulating plate 238 formed of a glass fabric impregnated with epoxy resin. In an example, insulating plate 238 can be formed from commercially available material, such as the well-known G10 laminate.

As shown in FIGS. 26A and 26B, insulating plate 238 covers the entire upward facing surface of body 212 of insulating plate 210 and extends between all of the shafts of Huck pins 222. Because of the insulating properties of insulating plate 210 and insulating plate 238, no bushings are required to isolate the shafts of Huck pins 222 from insulating plate 210 and/or insulating plate 238, in order to maintain Huck pins 222 electrically isolated from each other and electrically isolated from plates or members 130, 132.

Figure 27C:
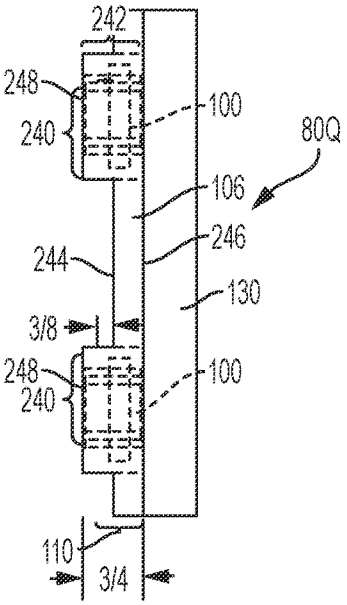
FIG. 27C is a side view of the gauge plate of FIG. 27A.
Figure 27A:
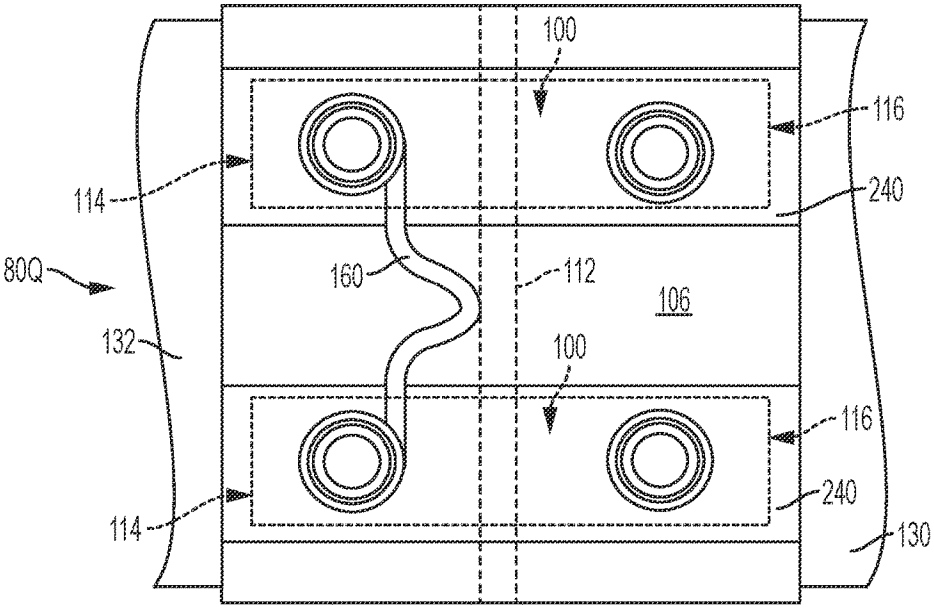
FIG. 27A is a top view of a gauge plate in accordance with a further embodiment of the present application.
Figure 27B:
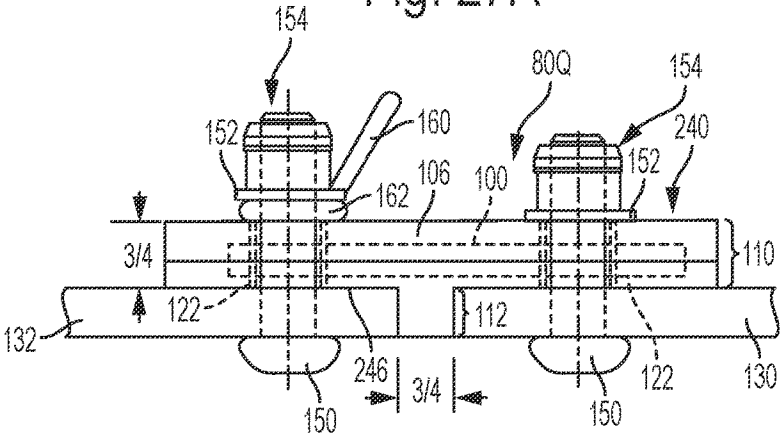
FIG. 27B is a front view of the gauge plate of FIG. 27A.

With reference to FIGS. 27A-27C, a gauge plate assembly 80Q according to a further embodiment is similar in most respects to the gauge plate insulator 70 shown in FIGS. 9A-9C with at least the following exceptions. Each metallic core 100 includes squared first and second ends 114, 116, versus radiused or rounded ends 114 and 116 shown in FIG. 9A. Moreover, the body 110 of insulating material 106 encasing each metallic plate 100 is a rectangular cube-like structure 240. Each rectangular cube-like structure 240 rises a distance 242 above a first level 244 of the surface of insulating material 106. In the example shown in FIGS. 27A-27C, the total distance between the bottom surface 246 of body 110 of insulating plate 106 and a top surface 248 of each rectangular cube-like structure 240 is ¾ inch and distance 242 between first level 244 and the top surface 248 of each rectangular cube-like structure 240 is ⅜ inch, although other suitable arrangements may be utilized.

Figure 28C:
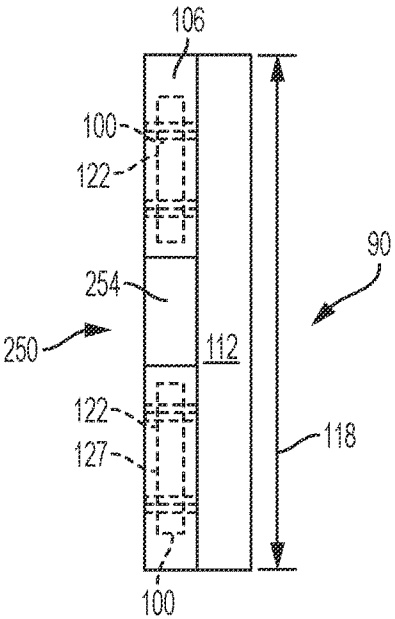
FIG. 28C is a side view of the gauge plate of FIG. 28A.
Figure 28A:
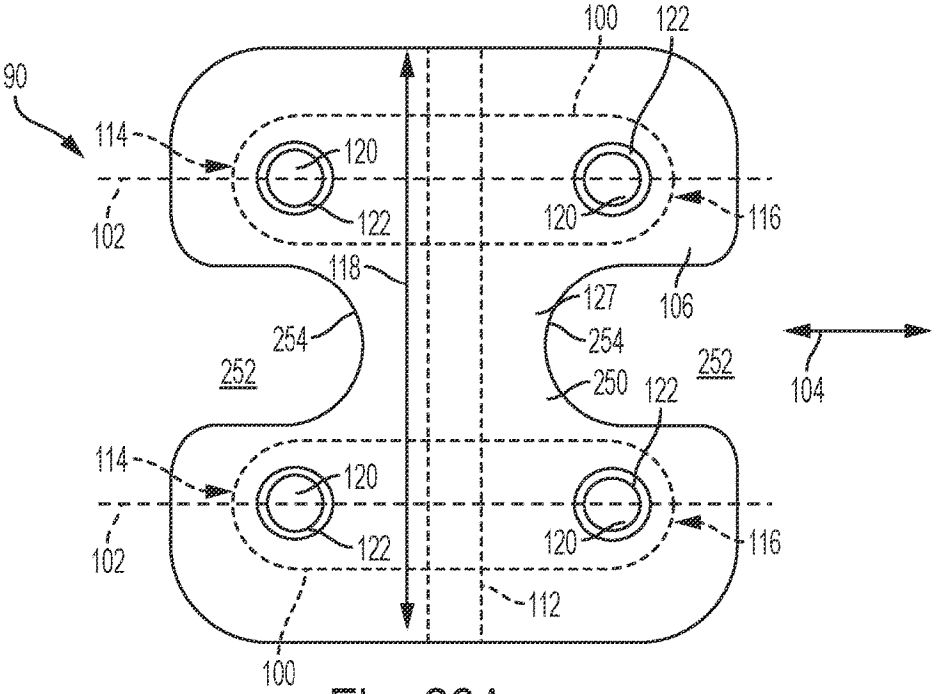
FIG. 28A is a top view of a gauge plate in accordance with a further embodiment of the present application.
Figure 28B:
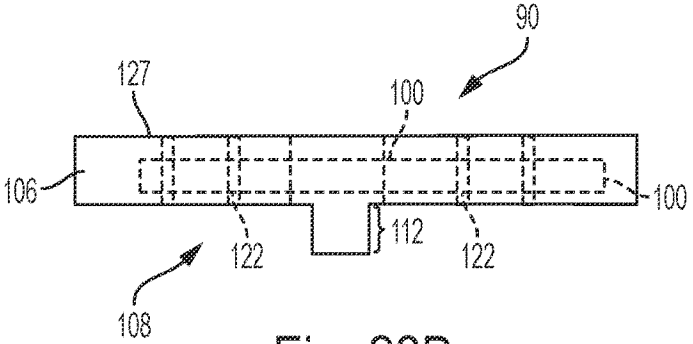
FIG. 28B is a front view of the gauge plate of FIG. 28A.

With reference to FIGS. 28A-28C, a gauge plate insulator 90 according to a further embodiment is similar in most respects to the gauge plate insulator 70 shown in FIGS. 9A-9C with at least the following exceptions. The plateaus 126 of the gauge plate insulator 70 shown in FIGS. 9A-9C are omitted in the gauge plate insulator 90 shown in FIGS. 28A-28C in favor of the surface 127 being planar. The optional expansion slots 124 are also omitted in the example gauge plate shown in FIGS. 28A-28C.

Moreover, the gauge plate insulator 90 of FIGS. 28A-28C includes a bridge 250 formed of electrically insulating material 106 between metal plates 100. In an example, this bridge 250 is in vertical alignment with depending leg 112, although other suitable arrangements may be utilized. As can be seen, bridge 250 is formed by the omission of electrically insulating material 106 in spaces 252 on either side of bridge 250 and depending leg 112. As shown best in FIG. 28A, the gauge plate insulator 90 has an H-shape wherein the legs of the "H" are formed by the pair of steel cores 100 encased by insulating material 106 and the bar that extends between the legs defines bridge 250 and is formed solely of insulating material 106.

In the example shown in FIGS. 28A-28C, the opposite sides of bridge 250 are curved or arched 254 away from depending leg 112, although other suitable arrangements may be utilized. The portions of insulating material 106 around each steel core 100 can also be curved around their corners to avoid sharp edges.

The foregoing examples have been described with reference to the accompanying figures. Modifications and alterations will occur to others upon reading and understanding the foregoing examples which are provided for the purpose of illustration and are not to be construed in a limiting sense. For example, while the use of Huck pins and Huck collars is disclosed, the use of any other suitable and/or desirable fastener arrangement in replacement of a Huck pin/Huck collar combination is envisioned. Accordingly, the foregoing examples are not to be construed as limiting the disclosure

The invention claimed is:

1. A gauge plate insulator comprising:

an L-shaped insulating member having a base configured to be positioned between first and second gauge plate members and a leg extending from the base;

a metallic backing plate having a first part configured to engage a first gauge plate member, a second part configured to engage the leg of the L-shaped insulating member, and a third part extending between the first part and the second part of the metallic backing plate and configured to engage a portion of the base of the L-shaped insulating member;

a first fastener configured to be received by a first opening defined by the first part of the metallic backing plate to secure the metallic backing plate to a first gauge plate member and a second fastener configured to be received by a second opening defined by the second part of the metallic backing plate and an opening defined by the leg of the L-shaped insulating member; and an insulation plate configured to be positioned between a portion of the second fastener and the second part of the metallic backing plate, wherein the first and second fasteners each comprise a Huck collar and a Huck pin.

2. The gauge plate insulator of claim 1, further comprising a first washer configured to be positioned between a portion of the first fastener and the metallic backing plate and a second washer configured to be positioned between a portion of the second fastener and the insulation plate.

3. The gauge plate insulator of claim 2, wherein the first and second washers each comprise a hardened flat washer.

4. The gauge plate insulator of claim 1, wherein the first opening comprises a pair of spaced-apart openings and the second opening comprises a pair of spaced-apart openings, and wherein the first fastener comprises a pair of first fasteners each received by one of the pair of spaced-apart openings of the first opening.

5. The gauge plate insulator of claim 4, further comprising a pair of insulated bushings received by the pair of spaced-apart openings of the second opening.

6. The gauge plate insulator of claim 1, wherein a thickness of the base of the L-shaped insulating member is greater than a thickness of the leg of the L-shaped insulating member.

7. A gauge plate insulator comprising:

an L-shaped insulating member having a base configured to be positioned between first and second gauge plate members and a leg extending from the base;

a metallic backing plate having a first part configured to engage a first gauge plate member, a second part configured to engage the leg of the L-shaped insulating member, and a third part extending between the first part and the second part of the metallic backing plate and configured to engage a portion of the base of the L-shaped insulating member;

a first fastener configured to be received by a first opening defined by the first part of the metallic backing plate to secure the metallic backing plate to a first gauge plate member and a second fastener configured to be received by a second opening defined by the second part of the metallic backing plate and an opening defined by the leg of the L-shaped insulating member;

an insulation plate configured to be positioned between a portion of the second fastener and the second part of the metallic backing plate, wherein the first opening comprises a pair of spaced-apart openings and the second opening comprises a pair of spaced-apart openings, and wherein the first fastener comprises a pair of first fasteners each received by one of the pair of spaced-apart openings of the first opening; and a lifting bail, a first portion of the lifting bail is positioned between one of the pair of first fasteners and the metallic backing plate, a second portion of the lifting bail is positioned between the other one of the pair of first fasteners, and an intermediate portion of the lifting bail extending between the first and second portions of the lifting bail.

8. A gauge plate insulator for separating a first gauge plate member from a second gauge plate member, the first gauge plate member and the second gauge plate member maintaining a gauge of two laterally spaced apart rails, the gauge plate insulator comprising:

an L-shaped insulating member having a base positioned between the first and second gauge plate members and a leg extending from the base;

a metallic backing plate having a first part engaging the first gauge plate member, a second part engaging the leg of the L-shaped insulating member, and a third part extending between the first part and the second part of the metallic backing plate and engaging a portion of the base of the L-shaped insulating member;

a first fastener received by a first opening defined by the first part of the metallic backing plate to secure the metallic backing plate to the first gauge plate member and a second fastener received by a second opening defined by the second part of the metallic backing plate and an opening defined by the leg of the L-shaped insulating member; and an insulation plate positioned between a portion of the second fastener and the second part of the metallic backing plate.

9. The gauge plate insulator of claim 8, further comprising a first washer positioned between a portion of the first fastener and the metallic backing plate and a second washer positioned between a portion of the second fastener and the insulation plate.

10. The gauge plate insulator of claim 9, wherein the first and second washers each comprise a hardened flat washer.

11. The gauge plate insulator of claim 8, wherein the first opening comprises a pair of spaced-apart openings and the second opening comprises a pair of spaced-apart openings, and wherein the first fastener comprises a pair of first fasteners each received by one of the pair of spaced-apart openings of the first opening.

12. The gauge plate insulator of claim 11, further comprising a pair of insulated bushings received by the pair of spaced-apart openings of the second opening.

13. The gauge plate insulator of claim 8, wherein a thickness of the base of the L-shaped insulating member is greater than a thickness of the leg of the L-shaped insulating member.

* * * * *